US009617036B2

(12) United States Patent
Baker

(10) Patent No.: US 9,617,036 B2
(45) **Date of Patent: *Apr. 11, 2017**

(54) PACKAGING CONTAINER HAVING A SECURE CLOSURE MECHANISM

(71) Applicant: Jay Baker, Mayville, NY (US)

(72) Inventor: Jay Baker, Mayville, NY (US)

( * ) Notice: Subject to any disclaimer, the term of this patent is extended or adjusted under 35 U.S.C. 154(b) by 64 days.

This patent is subject to a terminal disclaimer.

(21) Appl. No.: 14/693,293

(22) Filed: Apr. 22, 2015

(65) Prior Publication Data

US 2015/0225140 A1 Aug. 13, 2015

Related U.S. Application Data

(63) Continuation-in-part of application No. 13/844,669, filed on Mar. 15, 2013, now Pat. No. 9,045,256.

(51) Int. Cl.

| | |
|---|---|
| ***B65D 43/22*** | (2006.01) |
| ***B65D 21/02*** | (2006.01) |
| ***B65D 43/16*** | (2006.01) |
| ***B65D 25/04*** | (2006.01) |
| ***B65D 25/10*** | (2006.01) |
| ***B65D 25/24*** | (2006.01) |
| *B65D 25/22* | (2006.01) |

(52) U.S. Cl.

CPC ..... *B65D 21/0219* (2013.01); *B65D 25/04* (2013.01); *B65D 25/108* (2013.01); *B65D 25/24* (2013.01); *B65D 43/162* (2013.01); *B65D 25/22* (2013.01); *B65D 2543/00194* (2013.01); *B65D 2543/00296* (2013.01); *B65D 2543/00361* (2013.01); *B65D 2543/00537* (2013.01); *B65D 2543/00666* (2013.01); *B65D 2543/00703* (2013.01); *B65D 2543/00731* (2013.01); *B65D 2543/00814* (2013.01)

(58) Field of Classification Search

CPC .... B65D 43/22; B65D 43/16; B65D 43/162; A45C 13/1084; A45C 13/12; A45C 13/1076; E05B 63/22; E05B 65/006; E05B 65/52

USPC ..... 220/281, 283, 260, 263, 781, 834, 833, 220/835, 315; 292/87; 206/1.5

See application file for complete search history.

(56) References Cited

U.S. PATENT DOCUMENTS

| | | | | |
|---|---|---|---|---|
| 4,520,943 | A * | 6/1985 | Nielsen | B65D 21/0233 220/281 |
| 4,925,041 | A * | 5/1990 | Pehr | B65D 43/164 215/216 |
| 5,137,260 | A * | 8/1992 | Pehr | B65D 43/164 215/216 |
| 5,147,035 | A * | 9/1992 | Hartman | B65D 75/366 206/45.23 |
| 5,862,935 | A * | 1/1999 | Dubois | B65D 1/46 220/281 |
| 5,899,334 | A | 5/1999 | Domerchie et al. | |
| 6,279,746 | B1 * | 8/2001 | Hussaini | B65D 75/366 206/461 |
| 7,527,151 | B2 | 5/2009 | Park | |

(Continued)

*Primary Examiner* — Steven A. Reynolds

(74) *Attorney, Agent, or Firm* — The Bilicki Law Firm, PC

(57) ABSTRACT

A packaging container having a secure closure includes a base section and a cover section, with the cover section adapted to cover said base section when in a closed state. The closure mechanism includes a first aperture formed within an inner wall segment of the base section and a second aperture formed within an outer wall segment of the base section. A projection extends inwardly from a side wall portion of the cover section for engaging the first and second apertures of the base section, wherein the closure mechanism retains the cover section over the base section and securing the packaging container in a closed position.

14 Claims, 28 Drawing Sheets

(56) References Cited

U.S. PATENT DOCUMENTS

| | | | | |
|---|---|---|---|---|
| 7,591,656 | B1 * | 9/2009 | Gretz | H01R 13/447 439/108 |
| 7,654,411 | B2 * | 2/2010 | Boots | B65D 43/162 215/237 |
| 7,699,169 | B2 | 4/2010 | Lewis | |
| 7,926,659 | B2 | 4/2011 | Kim | |
| 7,975,849 | B2 | 7/2011 | Kim | |
| 8,042,690 | B2 | 10/2011 | Lewis | |
| 8,505,724 | B2 | 8/2013 | Bult et al. | |
| 8,613,357 | B2 | 12/2013 | Putnam | |
| 8,800,769 | B2 | 8/2014 | Ehde | |
| 2004/0118737 | A1 * | 6/2004 | Welsh | B65D 21/0233 206/508 |
| 2006/0081493 | A1 | 4/2006 | Park | |
| 2007/0235362 | A1 | 10/2007 | Lewis | |
| 2007/0272577 | A1 | 11/2007 | Kim | |
| 2008/0245691 | A1 | 10/2008 | Kim | |
| 2010/0307940 | A1 | 12/2010 | Kim | |
| 2012/0103852 | A1 | 5/2012 | Putnam | |
| 2012/0111858 | A1 | 5/2012 | Lewis | |
| 2012/0199598 | A1 | 8/2012 | Lewis | |
| 2013/0105343 | A1 | 5/2013 | Bult et al. | |
| 2014/0131238 | A1 | 5/2014 | Ehde | |

* cited by examiner

PACKAGING CONTAINER HAVING A SECURE CLOSURE MECHANISM

FIELD OF THE INVENTION

The present invention relates to a packaging container, more specifically, to clamshell-type packaging containers. Clamshell packaging is used for secure display or storage of items.

CROSS-REFERENCE TO RELATED APPLICATIONS

This application is a continuation-in-part of and claims priority to U.S. patent application Ser. No. 13/844,669, filed Mar. 15, 2013, the entire contents of which are incorporated by reference herein.

BRIEF SUMMARY

A packaging container includes a base section defining a chamber with spaced apart inner and outer wall segments with the outer wall segment including at least one aperture formed therein and a laterally extending flange extending therefrom. At least one depression is formed within the outer wall segment with the at least one aperture formed within the at least one depression.

The packaging container further includes a cover section having a side wall portion defining a cover; the cover section is pivotally coupled to the base section and configured to pivot between an open state and a closed state. At least one inwardly protruding section is formed in the side wall portion of the cover section and is shaped to correspond with the at least one depression formed within the outer wall segment of the base section. The at least one projection is formed within the at least one inwardly protruding section and extends inwardly from wall segment of the cover section for engaging the at least one aperture formed within the outer wall segment of base section, thereby retaining the cover section over the base section and securing the packaging container in a closed position.

A recessed face formed in the cover section which extends towards the at least one first aperture formed within the inner wall segment of the base section when the packaging container is in a closed position such that movement of the inner wall segment is hindered by the recessed face when the deformable flange is depressed, preventing the projection from being released from the at least one first aperture and the at least one second aperture.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1A:
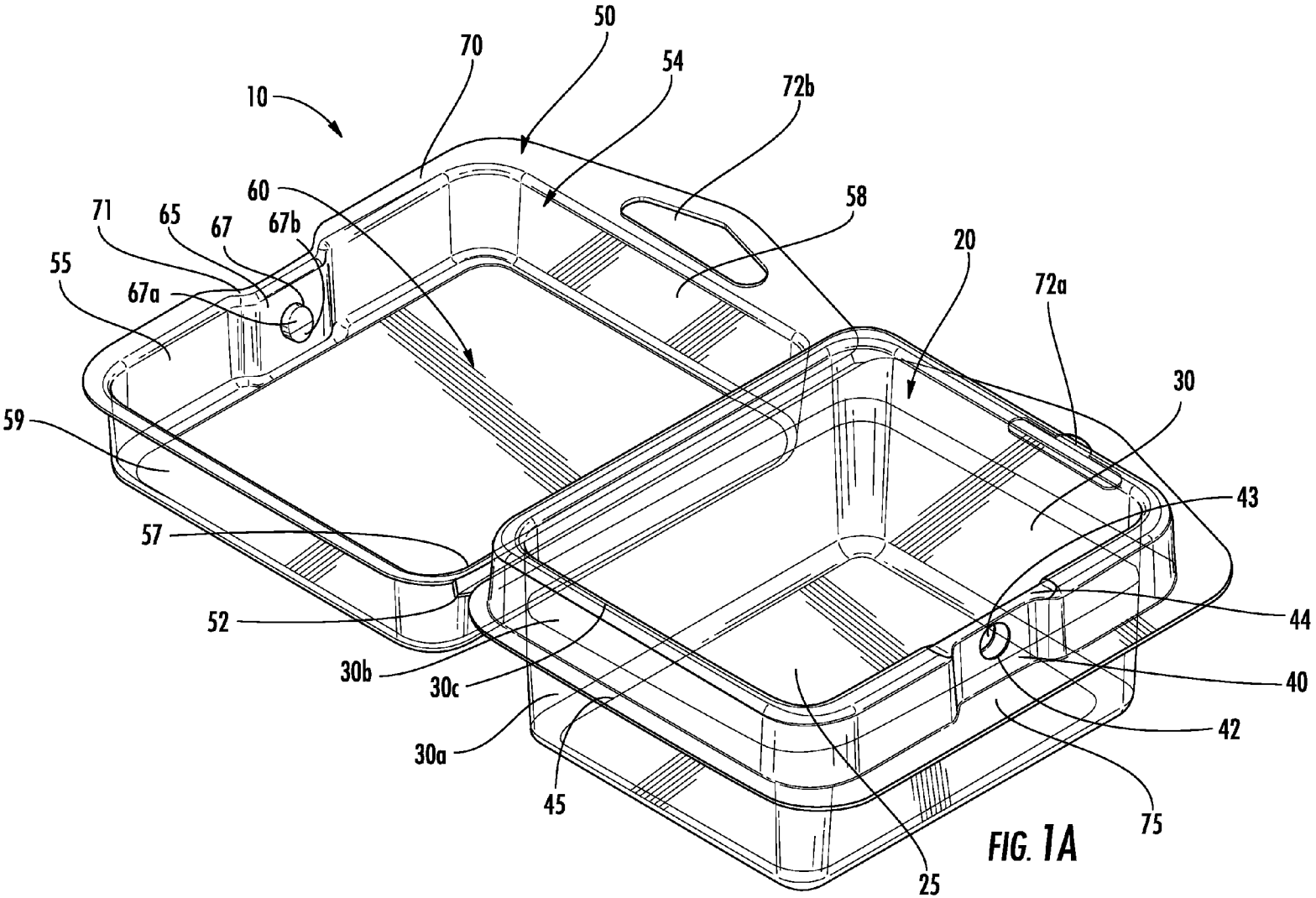
FIG. 1A is a perspective view of a packaging container according to an embodiment of the present invention, in which the packaging container is opened.
Figure 1B:
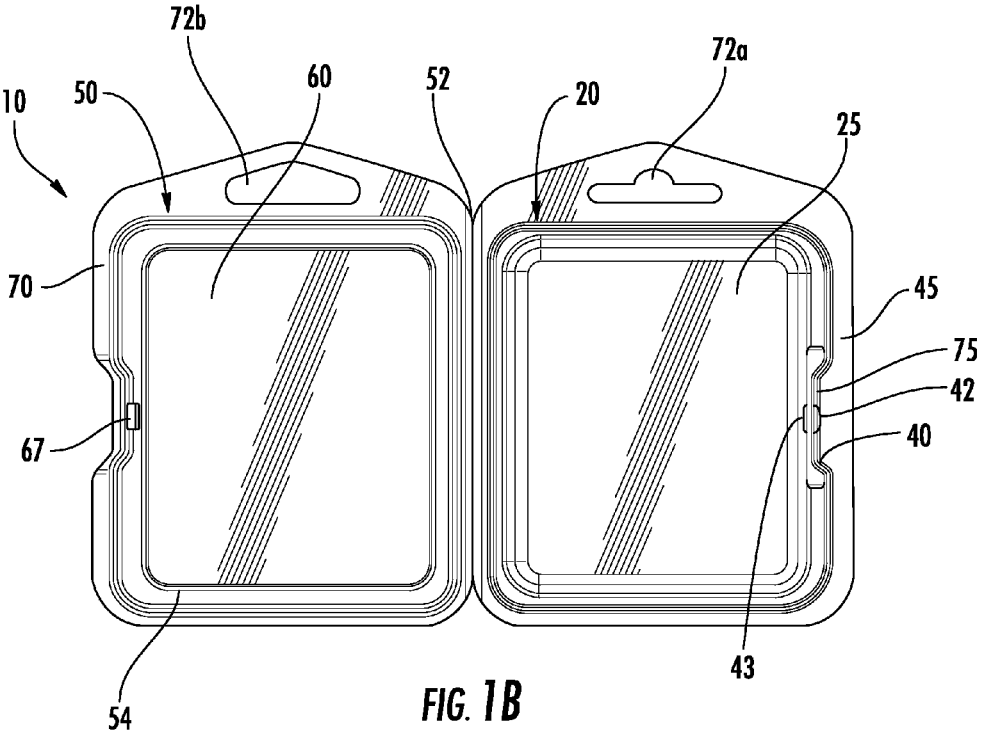
FIG. 1B is a front view of the packaging container of FIG. 1A in an open configuration.
Figure 1C:
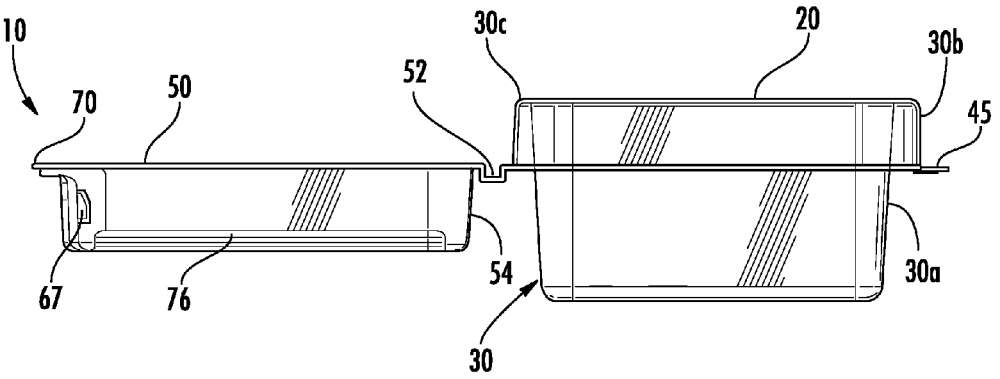
FIG. 1C is an end view of the packaging container of FIG. 1A in an open configuration.
Figure 1D:
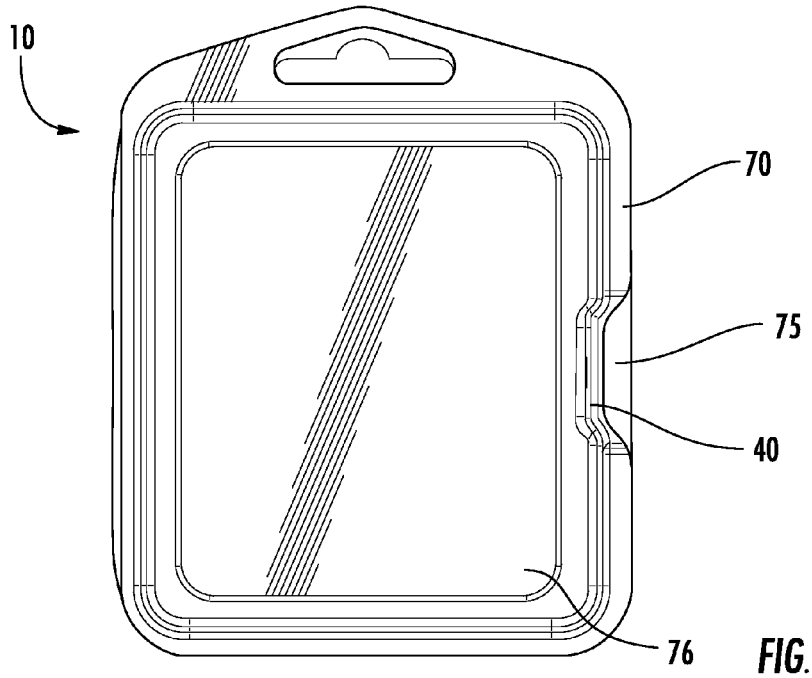
FIG. 1D is a front view of the packaging container of FIG. 1A, in which the packaging container is closed.
Figure 1E:
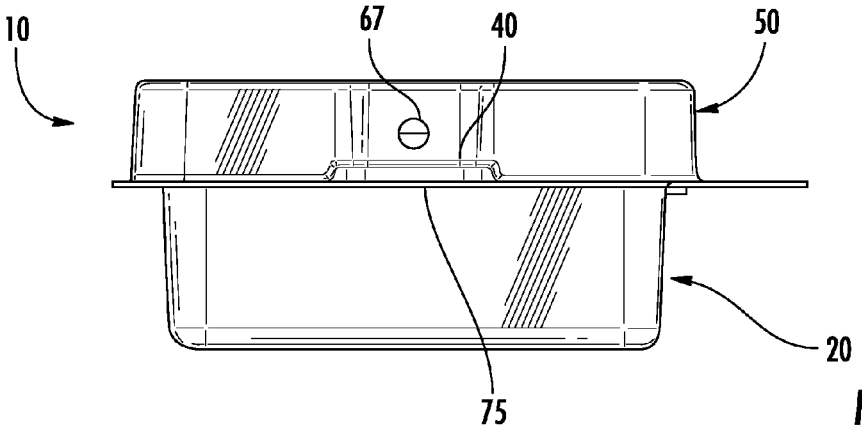
FIG. 1E is a side view the packaging container of FIG. 1A in a closed state.
Figure 1F:
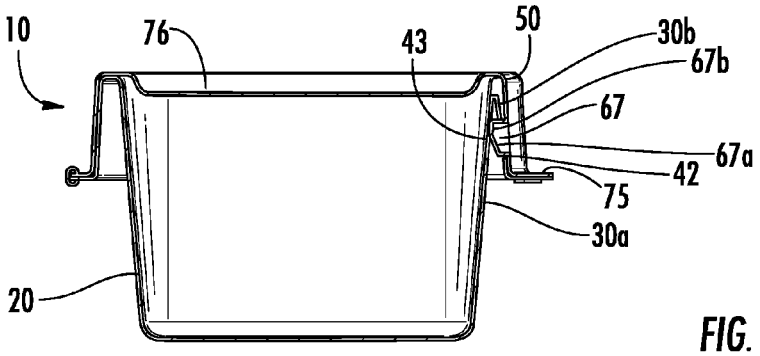
FIG. 1F is an end view of the packaging container of FIG. 1A in a closed state.
Figure 1G:
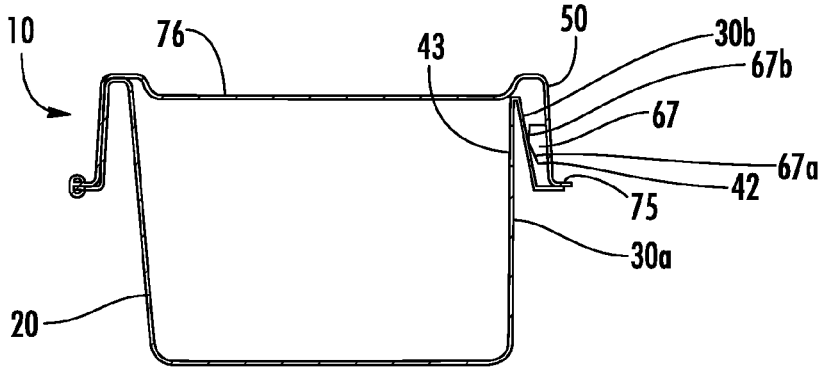
FIG. 1G illustrates an end view of the packaging container of FIG. 1A in a closed state with a flange depressed.
Figure 1H:
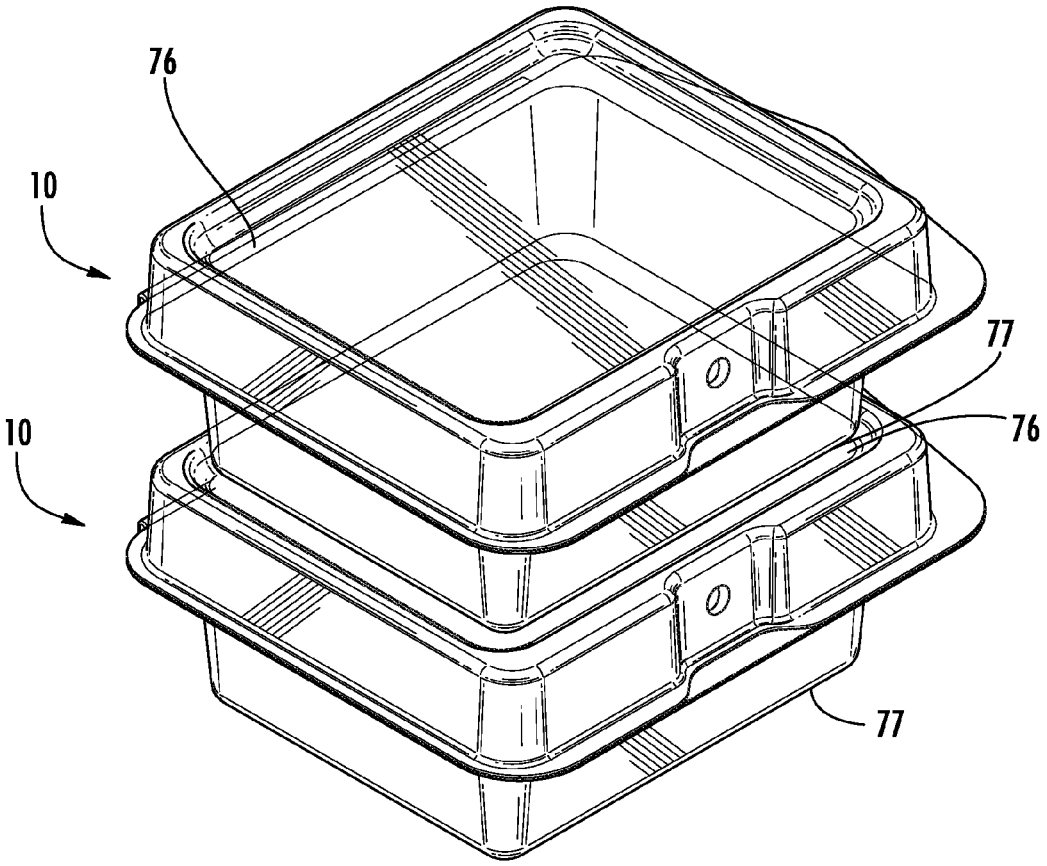
FIG. 1H multiple packaging containers in a stacked configuration.

In accordance with the present embodiments of a packaging container, FIG. 1A illustrates a perspective view of a packaging container 10, in which packaging container 10 is opened to accommodate desired contents. FIG. 1B is a front view of the packaging container of FIG. 1A in an open configuration. FIG. 1C is an end view of the packaging container of FIG. 1A in an open configuration. FIGS. 1D, 1E, and 1F are front, side, and end views of packaging container 10 closed state. FIG. 1H illustrates multiple packaging containers 10 in a stacked configuration.

Packaging container 10 includes a base section 20 having a chamber 25 defined by a peripheral wall 30. Peripheral wall 30 forms the perimeter of chamber 25 and is collectively formed by spaced-apart inner wall segment 30*a* and an outer wall segment 30*b* adjoined by a top ledge 30*c*.

In order to facilitate a secure closure of packaging container 10, outer wall segment 30*b* includes at least one depression 40 formed therein. At least one aperture 42 is formed within depression 40 for engaging an inwardly protruding section formed on a cover section 50, as will be discussed in detail below. A plurality of apertures 42 may be included in some embodiments. At least one additional aperture 43, which aligns with aperture 42, may also be formed within inner wall segment 30*a* of peripheral wall 30. Top ledge 30*c* also includes a scalloped area 44 formed therein adjacent to depression 40 formed within outer wall segment 30*b* for facilitating release of cover section 50. Further, a laterally extending flange 45 extends from outer wall segment 30*b* as show in FIG. 1A.

Packaging container 10 also includes a cover section 50 pivotally coupled to base section 20 at a hinge 52. Cover section 50 is configured to pivot about hinge 52 between an open state and a closed state. In particular, cover section 50 includes a top surface having a recessed face 77 and side wall portion 54, which is collectively formed by first and second lateral walls 55, 57 and first and second end walls 58, 59. Side wall portion 54 defines a cover compartment 60 that fits over base section 20. First lateral wall 55 includes at least one inwardly protruding section 65 shaped to correspond with depression 40 formed within outer wall segment 30*b* of peripheral wall 30. In addition, a post 67 projects from inwardly protruding section 65. In one embodiment, post 67 includes an angled edge 67*a* and a top edge 67*b*. Post 67 is adapted to engage corresponding apertures 42 and 43. A peripheral flange 70 extends horizontally from a perimeter of cover section 50 such that, when packaging container 10 is in a closed position, peripheral flange 70 abuts flange 45 of base section 20. Peripheral flange 70 includes a cut out area 71 adjacent to inwardly protruding section 65, as will be discussed below.

In order to provide a container that is secure when closed, but is also easy to open by a user, packaging container 10 includes features that allows for easy one-hand opening. In particular, laterally extending flange 45 is deformable such that when flange 45 depressed in a region 75 adjacent to depression 40 of outer wall segment 30*b*, outer wall segment 30*b* and inner wall segment 30*a* move inwardly, as shown in FIG. 1G, thereby releasing post 67 from apertures 42 and 43 and opening packaging container 10. Peripheral flange 70 includes a cut out area 71 at inwardly protruding section 65 of side wall portion 54, such as to provide unobstructed access for depressing deformable flange 45 at region 75 of base section 20 for opening packaging container 10. Scalloped area 44 facilitates the inward movement of outer wall segment 30*b* and inner wall segment 30*a* by ensuring movement is not obstructed by recessed face 76 of the top surface.

Each of flanges 45 and 70 includes a hanger opening 72*a*, 72*b* formed at one side such that packaging container 10 can be hung on and kept in a display rack used for storage or selling of items contained in packaging container 10. When packaging container 10 is in a closed position hanger openings 72*a* and 72*b* align with one another. Hanger openings 72*a* and 72*b* are formed by a circular hole, a linear groove, or a combination such that packaging container 10 can be hung on any display rack having a circular rack rod or a thin plate-shaped rack rod. Thus, packaging container 10 can be suspended from a display rack through hanger openings 72*a* and 72*b*. In alternate embodiments, packaging container may include only one hanger opening 72*a*.

As shown in FIG. 1H, packaging container 10 includes a recessed face 76 which acts as a receiving area formed in a top surface of cover section 50. Recessed face 76 accepts and retains a bottom 77 of another packaging container 10 to allow for a stable stacking arrangement.

Figure 2A:
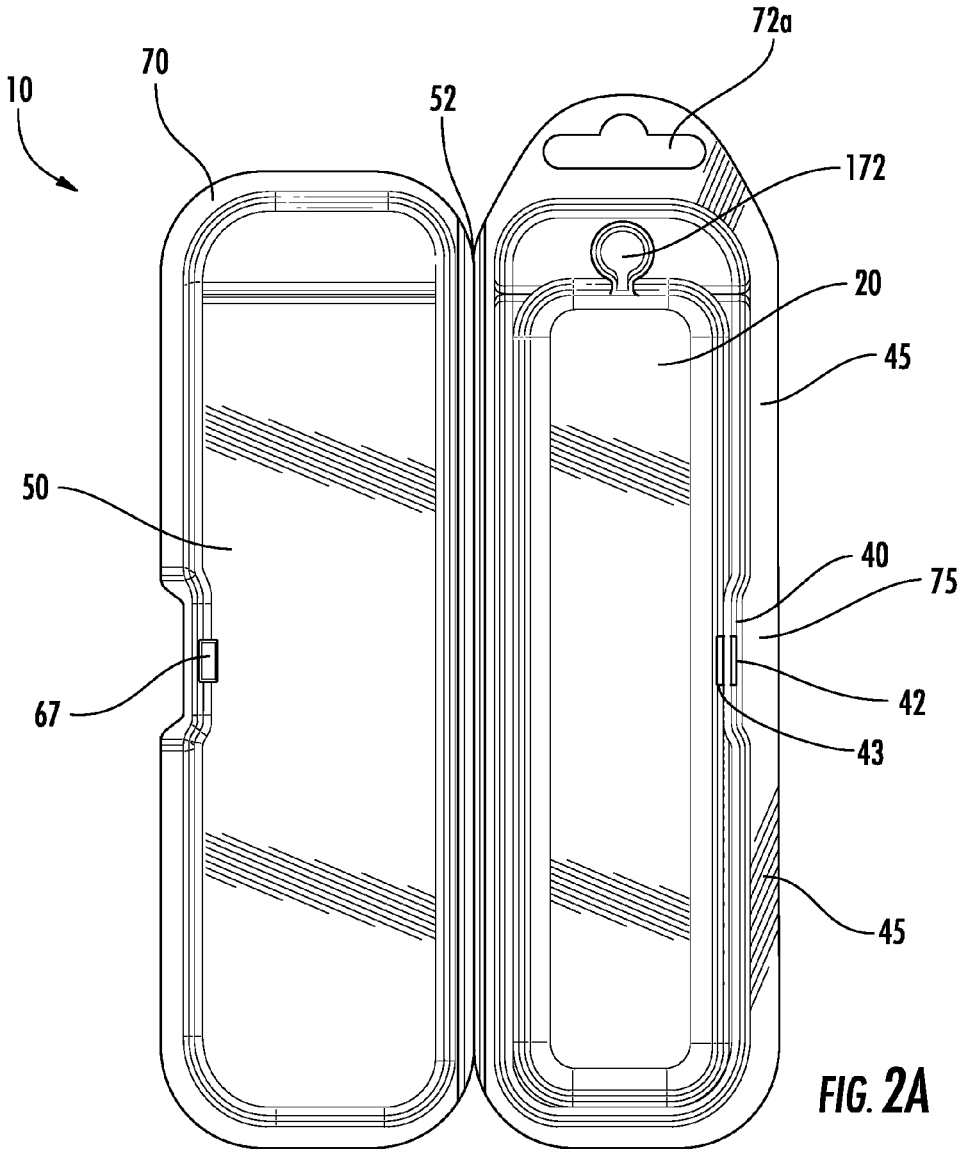
FIG. 2A is a front view of an alternate embodiment of a packaging container according to the present invention in an open configuration.
Figure 2B:
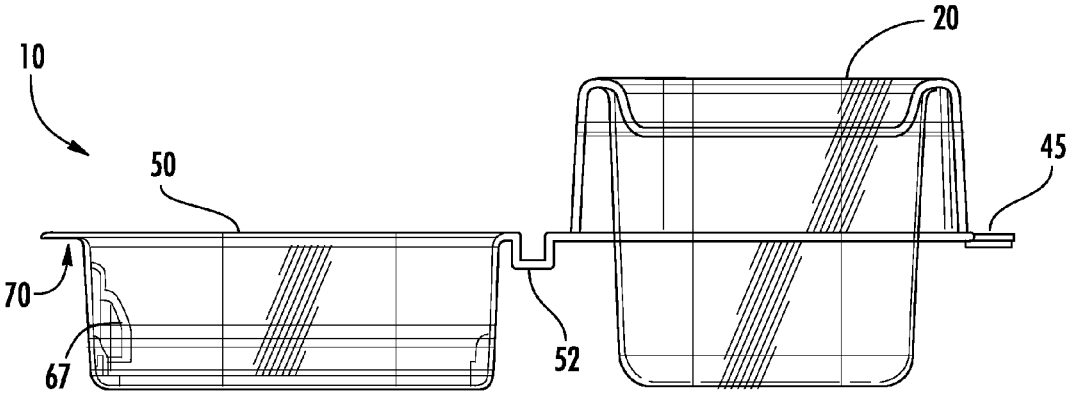
FIG. 2B is an end view of the packaging container of FIG. 2A in an open configuration.
Figure 2C:
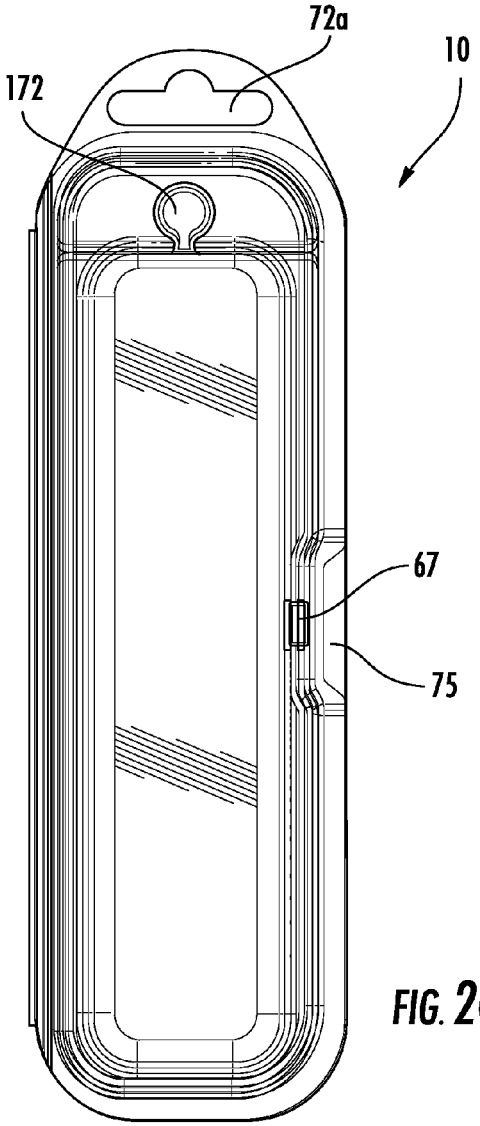
FIG. 2C is a front view of the packaging container of FIG. 2A, in which the packaging container is closed.
Figure 2D:
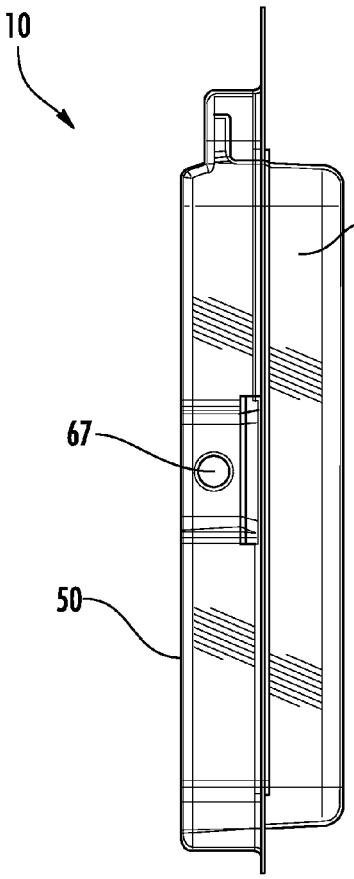
FIG. 2D is a side view the packaging container of FIG. 2A in a closed state.
Figure 2F:
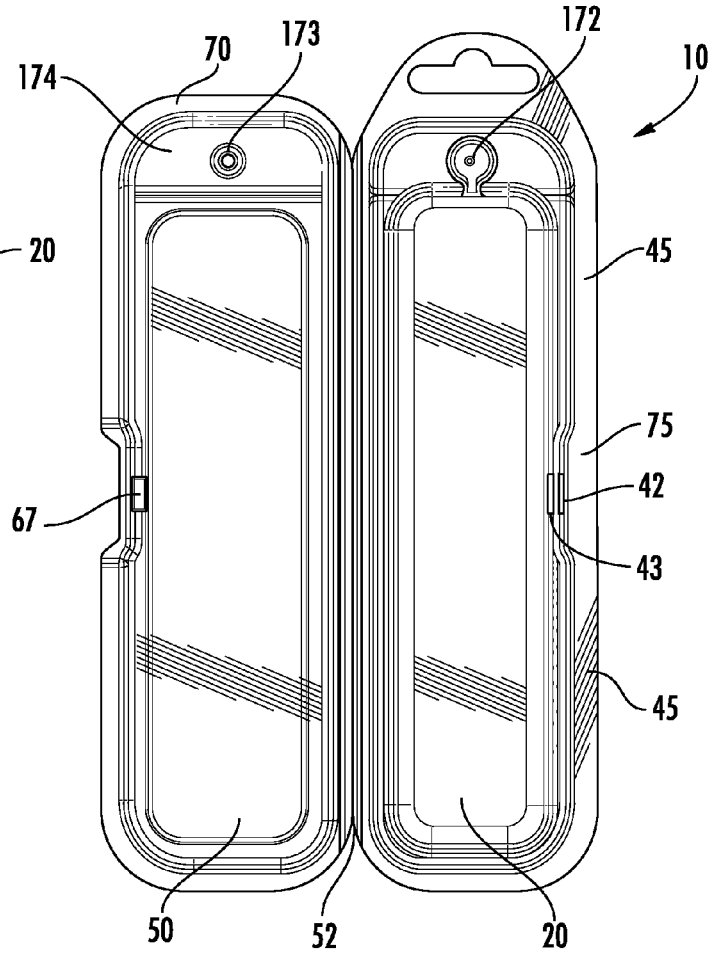
FIG. 2F is a view of an alternate embodiment of the packaging container of FIG. 2A in an open configuration.
Figure 2E:
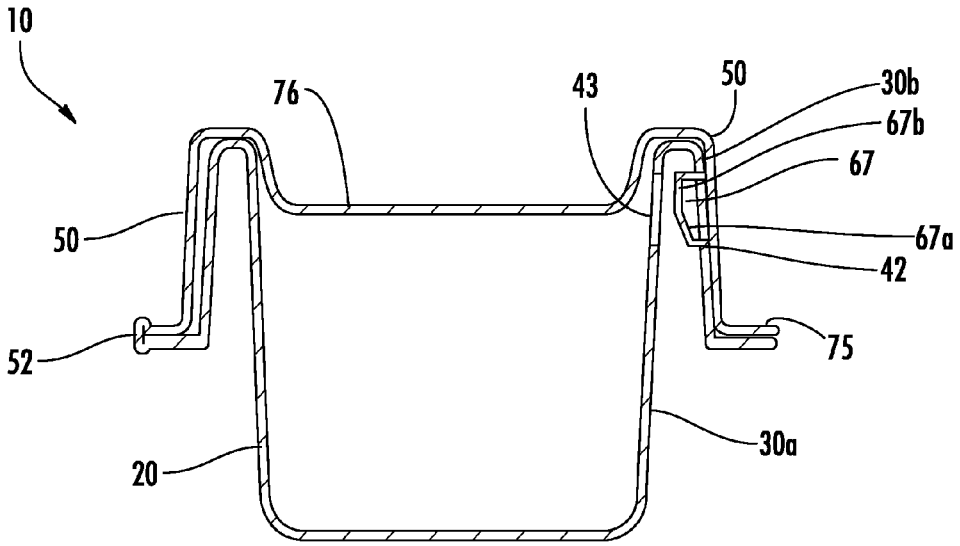
FIG. 2E is an end view of the packaging container of FIG. 2A in a closed state.

FIGS. 2A-2E illustrate an additional embodiment of packaging container 10. In this embodiment packaging container is elongated in order to accommodate items such as fishing lures or the like. The dimensions of packaging container may be, for example, about 4.5'×1"×1", about 5.75"×1×1, or about 7×1×1. FIG. 2A is a front view of packaging container 10 in an open position. FIG. 2B is an end view of packaging container 10, in which packaging container 10 is opened to accommodate contents. FIGS. 2C, 2D and 2E are front, side, and end views of packaging container 10 in a closed position.

For the sake of simplicity FIGS. 2A-2E include reference numbers corresponding to those described in FIGS. 1A-1H. Like elements that are assigned corresponding reference numbers will not be described in detail. However, as further shown in FIG. 2E, packaging container 10 may include a mating features, such as an O-shaped depression 172, formed in base portion 20 and a corresponding projection 173 formed in cover portion 50. The shape or configuration of the mating features can be varied and are surrounded by a space 174 such that when an item is positioned in container 10 a portion of the item can be held in place by the mating features.

In the embodiments shown in FIGS. 3A-3F, a packaging container 110 is illustrated having a base section 120 having a chamber 125 defined by a peripheral wall 130. Peripheral wall 130 forms the perimeter of chamber 125 and is collectively formed by spaced-apart inner wall segment 130*a* and an outer wall segment 130*b* adjoined by a top ledge 130*c*. Peripheral wall 130 extends along three sides of base section 120 and includes an open end 132. Further, chamber 125 includes a plurality of wells 123 formed within a bottom surface 126 for receiving items to be stored within packaging container 110.

Similar to the previously described embodiments, in order to facilitate a secure closure of packaging container 110, outer wall segment 130*b* includes at least one depression 140 formed therein. An aperture 142 is formed within depression 140 for engaging a projection formed on a cover section, as will be discussed in detail below. At least one additional aperture 143, which aligns with aperture 142, may also be formed within inner wall segment 130*a* of peripheral wall 130. A laterally extending flange 145 is extends from outer wall segment 130*b*.

Packaging container 110 further includes a plate 146 pivotally attached to base section 120 at hinge or pivot axis 151. Plate 146 including a plurality of holes 148 formed therein for aligning with plurality of wells 123 formed in bottom surface 126. Plate 146 is adapted to secure items positioned in wells 123. When plate 146 is in an open position, items may be placed in wells 123. Plate 146 may then be pivoted about hinge or pivot axis 151 such that it is parallel to bottom surface 126 and holes 148 are aligned with wells 123. Alternatively, plate 146 may be closed first allowing items, such as long cylindrical items, to be placed into through holes 148 and into wells 123. Plate 146 and holes 148 may provide support for holding such items within wells 123. Plate 146 includes a flange 149 which abuts ridges 124 of chamber 125, thereby holding plate 146 in a position parallel to a bottom surface of chamber 125. Once plate is in a closed position, cover section 150 may be pivoted over base section 120 as discussed below.

Cover section 150 pivotally coupled to base section 120 at a hinge 152. Cover section 150 is configured to pivot about hinge 152 between an open state and a closed state. In particular, cover section 150 includes a side wall portion 154 collectively formed by first and second lateral walls 155, 157 and first and second end walls 158, 159. Side wall portion 154 defines a cover compartment 160 that fits over base section 120. First lateral wall 155 includes at least one inwardly protruding section 165 shaped to correspond with depression 140 formed within outer wall segment 130*b* of peripheral wall 130. In addition, a post 167 projects from inwardly protruding section 165. Post 167 is adapted to engage corresponding aperture 142. A peripheral flange 170 extends horizontally from a perimeter of cover section 150 such that, when packaging container 110 is in a closed position, peripheral flange 170 abuts flange 145 of base section 120. Peripheral flange 170 includes a cut out area 171 adjacent to inwardly protruding section 165, as will be discussed below.

Figure 3A:
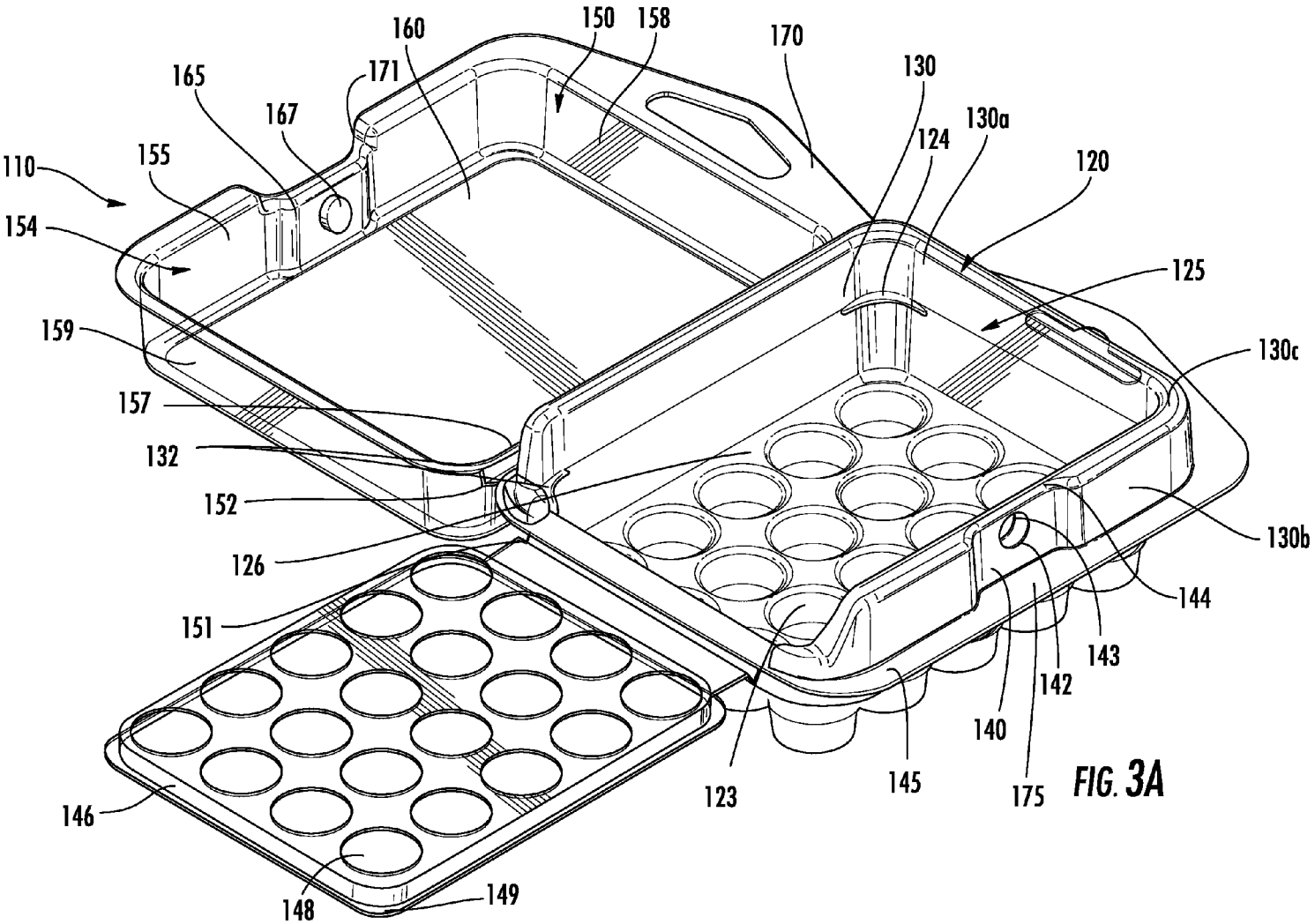
FIG. 3A is a perspective view of a packaging container according to another embodiment of the present invention, in which the packaging container is opened.
Figure 3B:
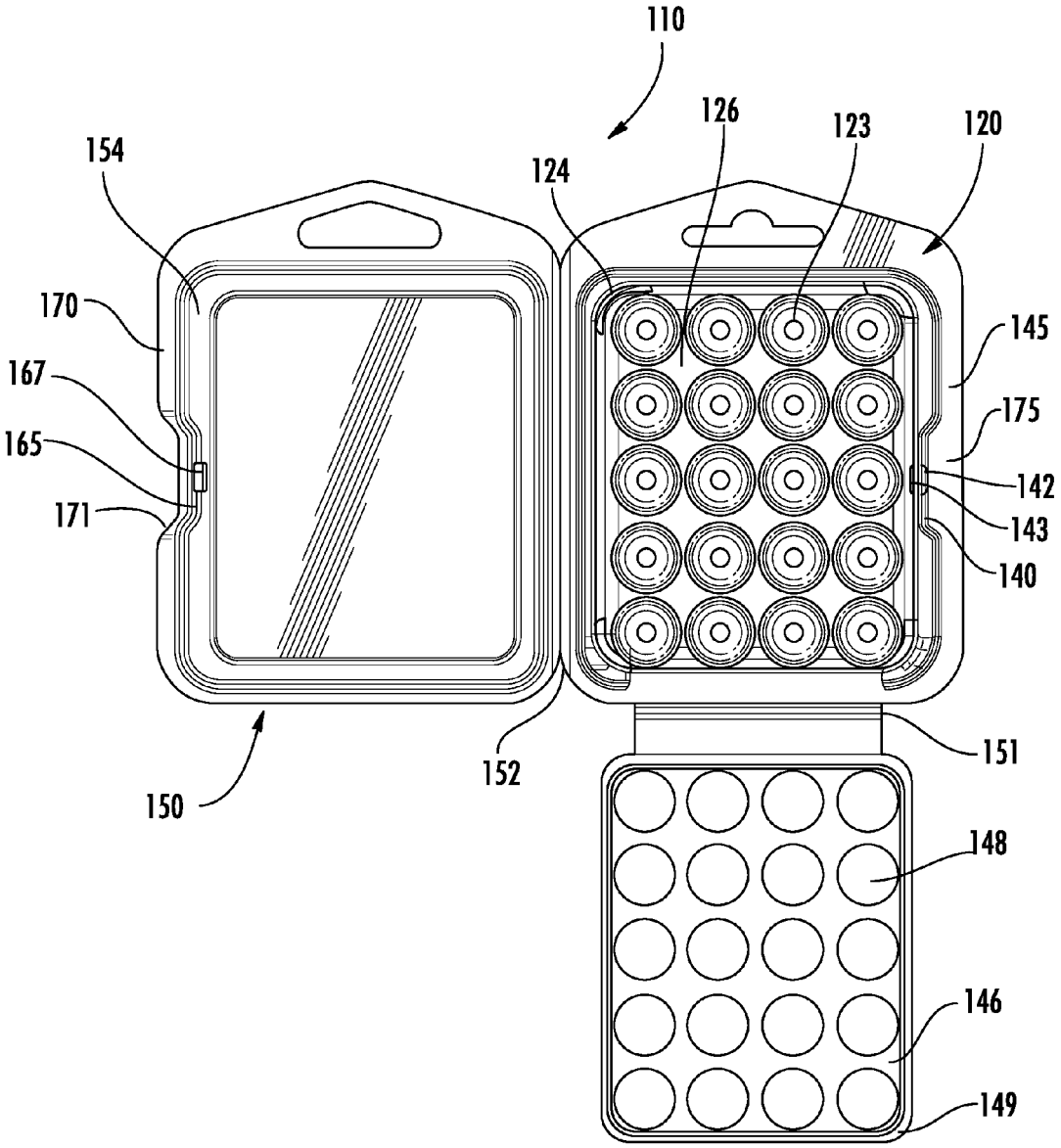
FIG. 3B is a front view of the packaging container of FIG. 3A in an open configuration.
Figure 3C:
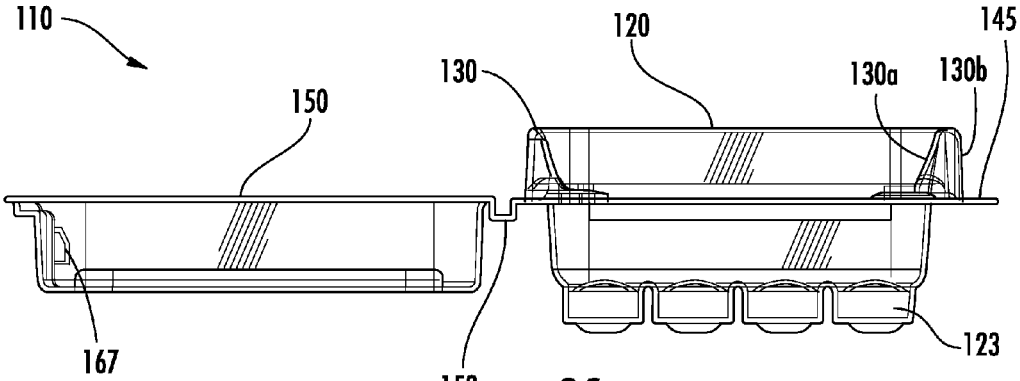
FIG. 3C is an end view of the packaging container of FIG. 3A in an open configuration.
Figure 3D:
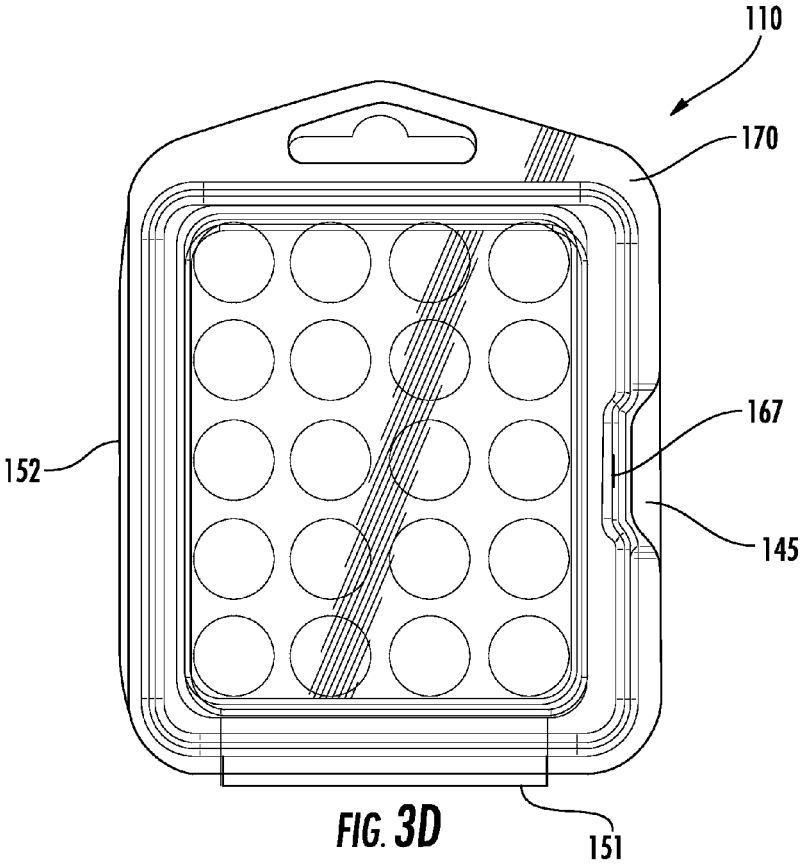
FIG. 3D is a front view of the packaging container of FIG. 3A, in which the packaging container is closed.
Figure 3E:
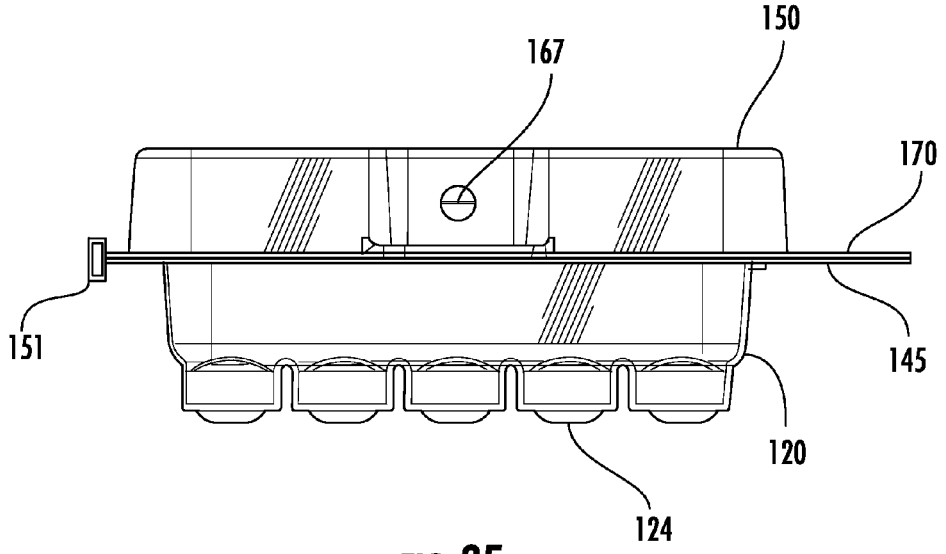
FIG. 3E is a side view the packaging container of FIG. 3A in a closed state.
Figure 3F:
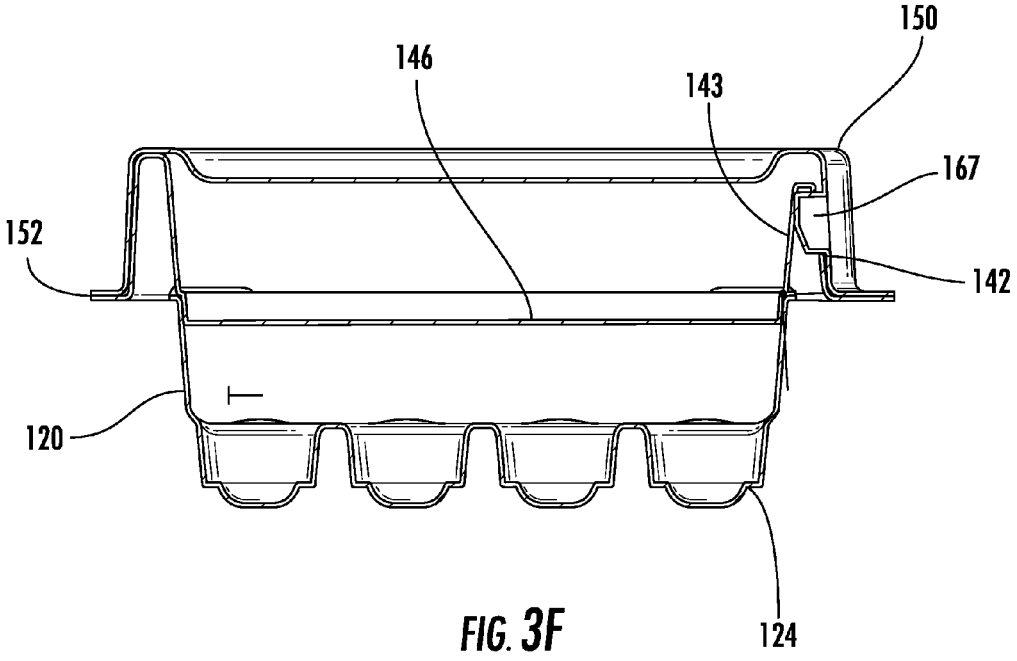
FIG. 3F is an end view of the packaging container of FIG. 3A in a closed state.

As discussed with respect to the embodiment of FIGS. 1A-2E, in order to provide a container that is secure when closed, but is also easy to open by a user, packaging container 110 includes features that allows for easy one-hand opening. In particular, with reference to FIG. 3B, laterally extending flange 145 is deformable such that when flange 145 depressed in a region 175 adjacent to depression 140 of outer wall segment 130*b*, outer wall segment 130*b* moves inwardly, and thereby releasing post 167 from apertures 142 and/or 143 and opening packaging container 110. Peripheral flange 170 of cover section 150 includes a cut out area 171 at inwardly protruding section 165 of side wall portion 154, such as to provide unobstructed access for depressing deformable flange 145 of base section 120 for opening packaging container 110 when in a closed position. A scalloped area 144 is also formed adjacent to depression 140 formed within outer wall segment 130*b* for facilitating release of cover section 150, as shown in FIG. 3A.

Figure 4A:
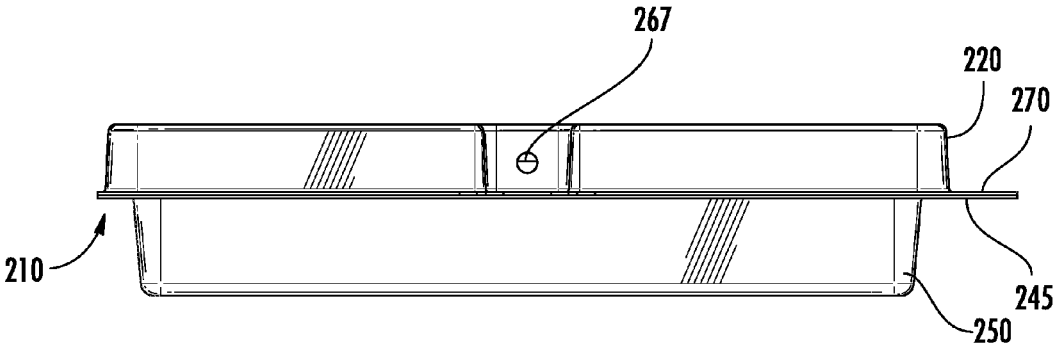
FIGS. 4A-4D illustrate assembled, bottom, cover, and assembled top views of an alternate embodiment of a packaging container.
Figure 4B:
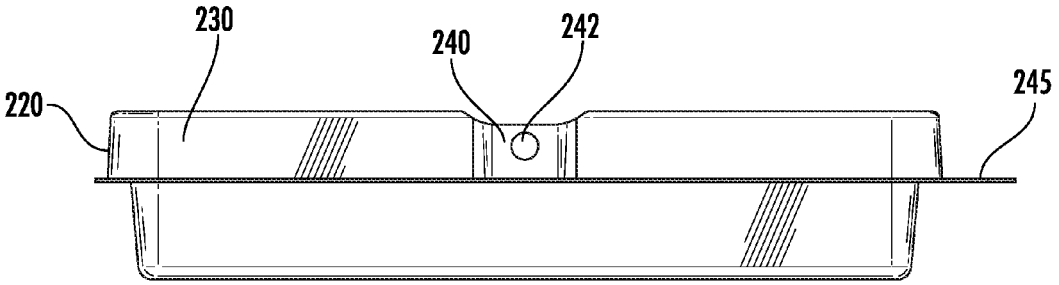
Figure 4C:
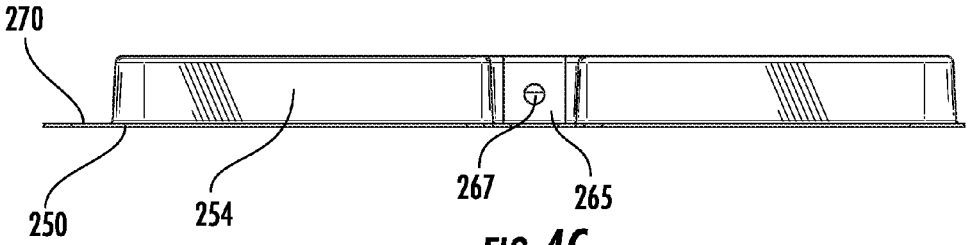
Figure 4D:
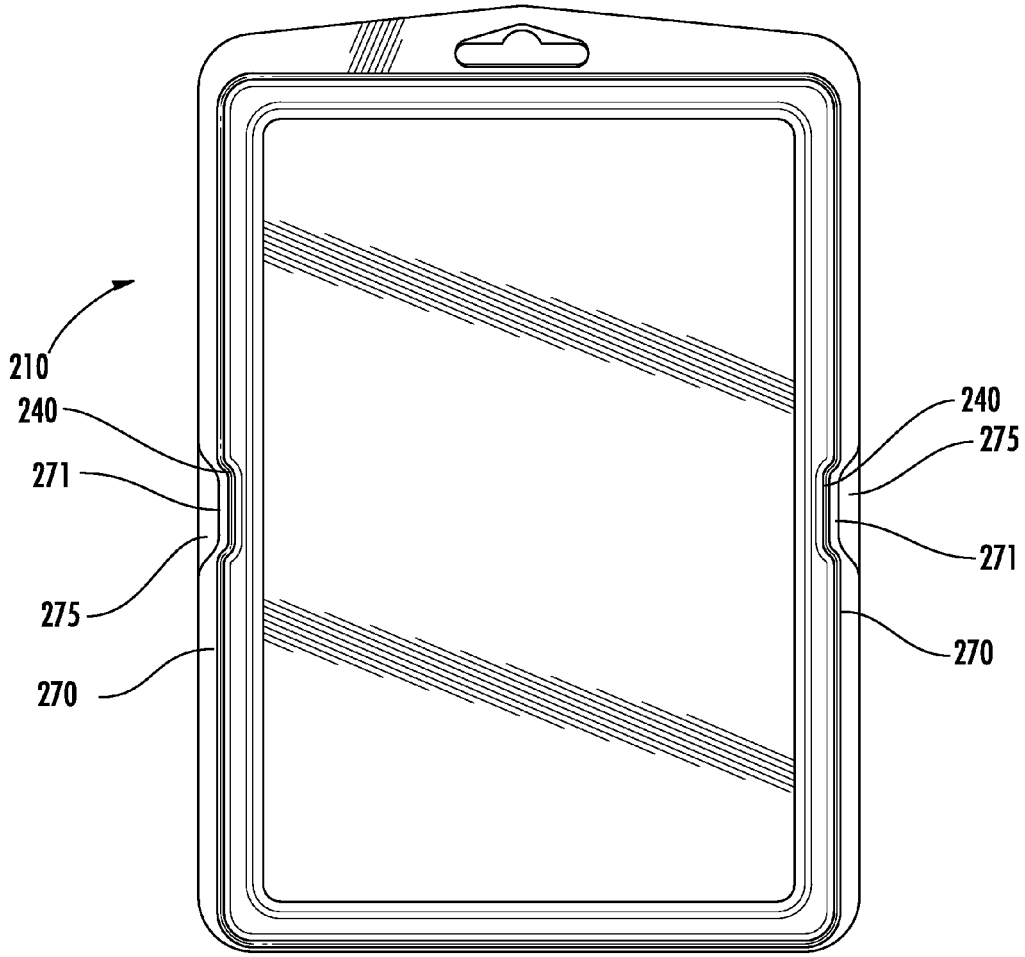

An additional embodiment is shown in FIGS. 4A-4D, wherein a packaging container 210 includes a base portion 220 and a separate cover portion 250. FIGS. 4A-4D illustrate assembled, bottom, cover, and assembled top views of packaging container 210. In order to facilitate a secure closure of packaging container 210, base portion 220 includes at least one depression 240 formed therein. An aperture 242 is formed within depression 240 for engaging a projection formed on cover section 250, as will be discussed in detail below. At least one additional aperture, which aligns with aperture 242, may also be formed within base portion 220. A laterally extending flange 245 is also provided. Cover section 250 includes a side wall portion 254 having at least one inwardly protruding section 265 shaped to correspond with depression 240 formed within a peripheral wall 230 of base portion 220. In addition, a post 267 projects from inwardly protruding section 265. Post 267 is adapted to engage corresponding aperture 242. A peripheral flange 270 extends horizontally from a perimeter of cover section 250, such that when packaging container 210 is in a closed position, peripheral flange 270 abuts flange 245 of base section 220. Peripheral flange 270 includes a cut out area 271 adjacent to inwardly protruding section 265, as shown in FIG. 4D.

Laterally extending flange 245 is deformable such that when flange 245 is depressed in a region 275 adjacent to depression 240, outer and inner segments of peripheral wall 230 move inwardly, thereby releasing post 267 from aperture 242 (and any additional apertures) and opening packaging container 210. Peripheral flange 270 of cover section 250 includes a cut out area 271 at inwardly protruding section 265 of side wall portion 254, such as to provide unobstructed access for depressing deformable flange 245 of base section 220 for opening packaging container 210. As shown in FIG. 4D, packaging container 210 includes corresponding elements on each side thereof such that when both first and second regions 275 are depressed, cover section 250 is released from base section 220.

Figure 5A:
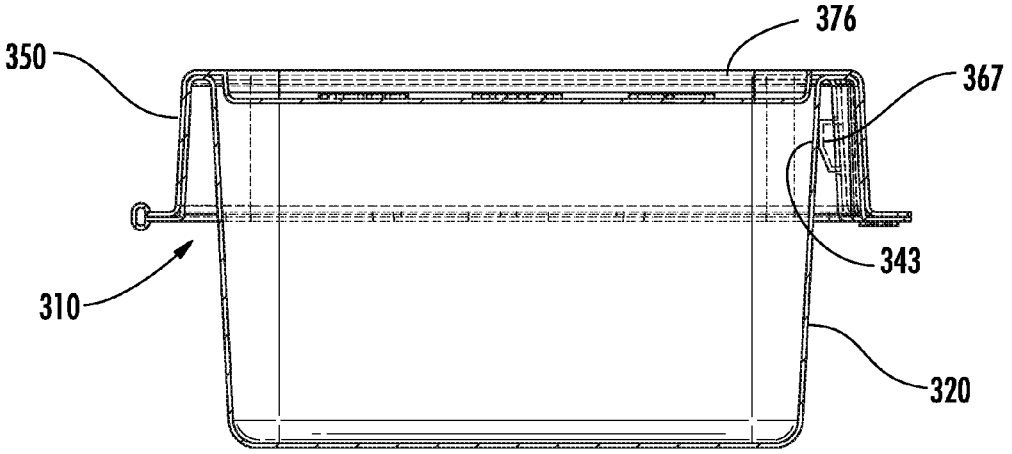
FIGS. 5A-5B illustrate side and enlarged side views of a locked packaging container according to an additional embodiment.
Figure 5B:
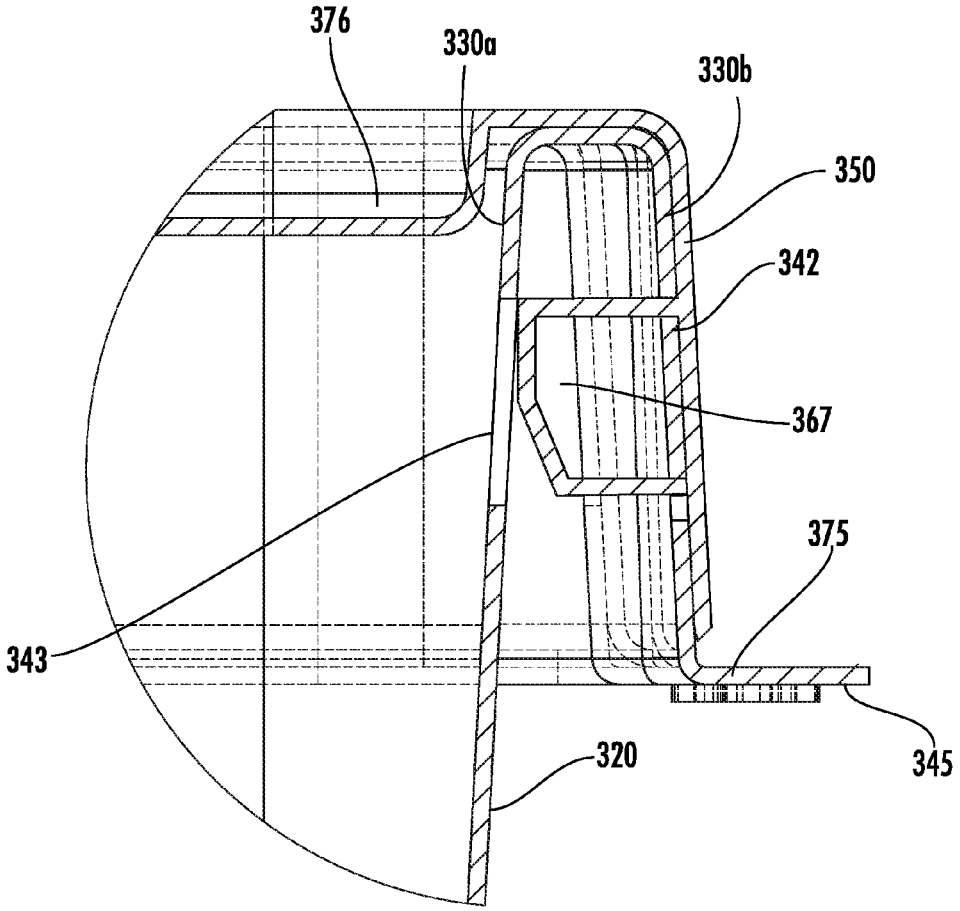

FIGS. 5A-5B illustrate side and enlarged side views of a lockable packaging container 310 according to an additional embodiment. Packaging container 310 includes a mechanism for locking which does not allow for easy opening. In particular, packaging container 310 includes elements corresponding to those of packaging container 10. Further, packaging container 310 includes at least one obstructive member for preventing the opening of packaging container 310. In particular, packaging container 310 includes an obstructive member in the form of a recessed face 376 formed in a cover section 350 which extends towards an aperture 343 formed in inner wall segment 330*a* of base section 320 when packaging container 310 is in a closed position. Laterally extending flange 345 is deformable such that when flange 345 is depressed in a region 375 of outer wall segment 330*b* adjacent to depression 340, outer wall segment 330*b* moves inwardly toward inner wall segment 330*a*. However, since recessed face 376 is formed within the top surface and extends adjacent to aperture 342 of inner wall segment 330*a*, movement of inner wall segment 330*a* is hindered by recessed face 376. Therefore, post 367 is not released from apertures 342 and 343 and cover section 350 remains secured in a closed position over base section 320.

Figure 5C:
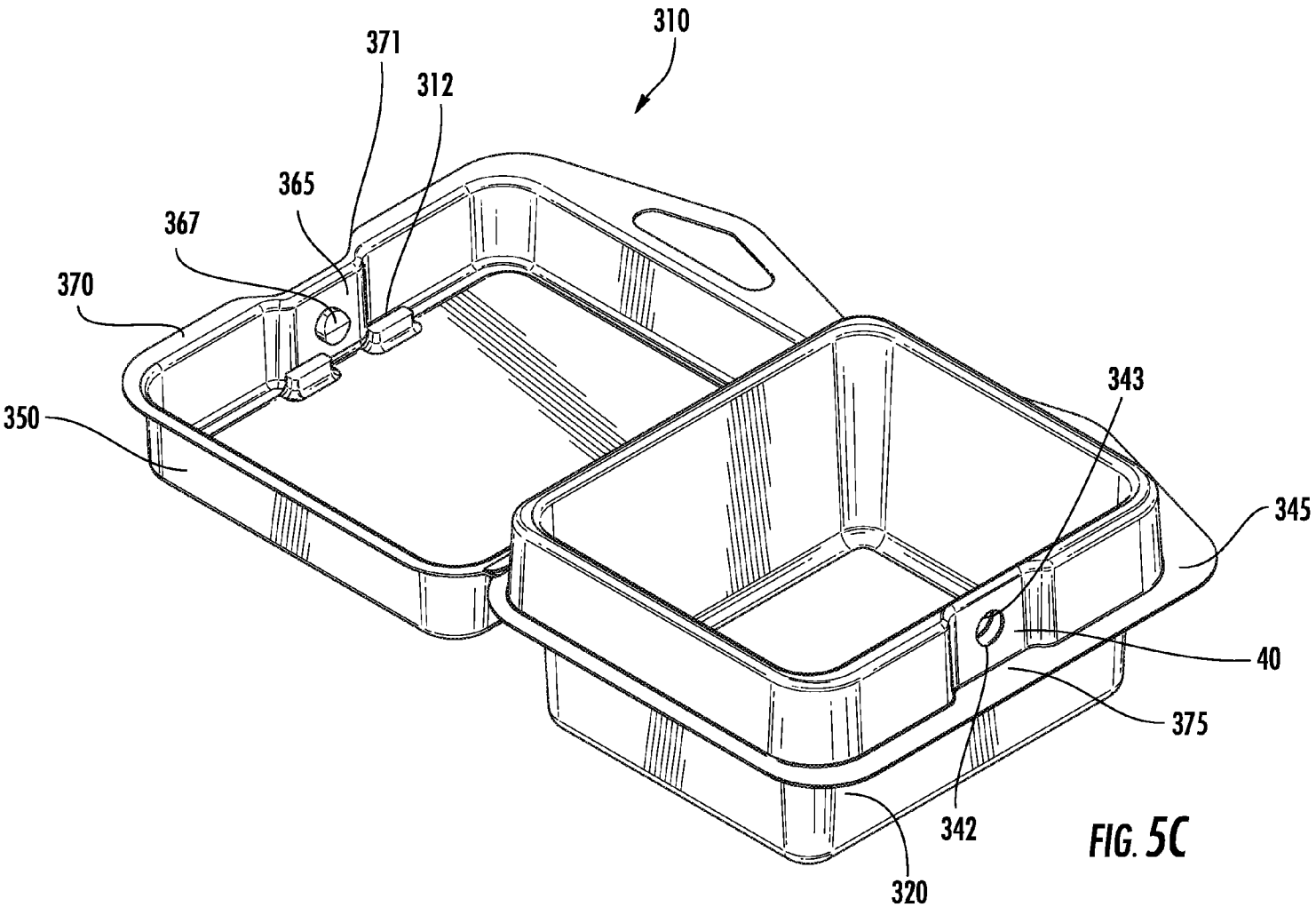
FIGS. 5C-5D illustrate perspective and side views of an alternate locked packaging container according to an embodiment of the invention.
Figure 5D:
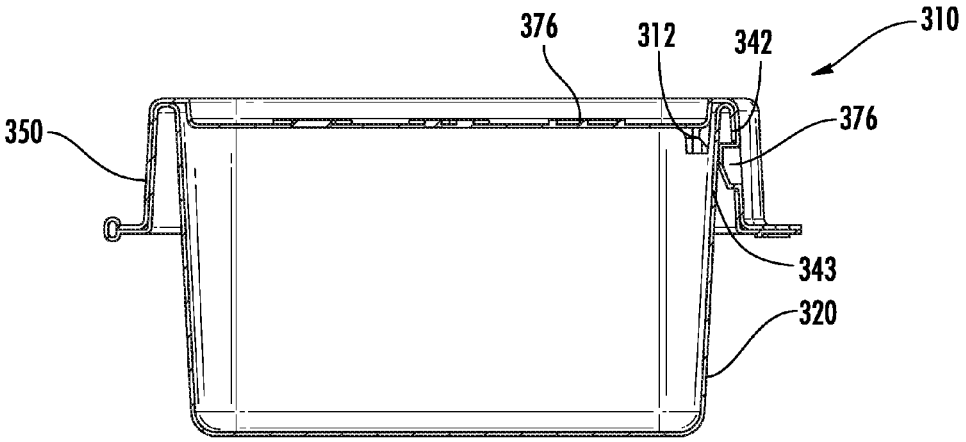
Figure 5E:
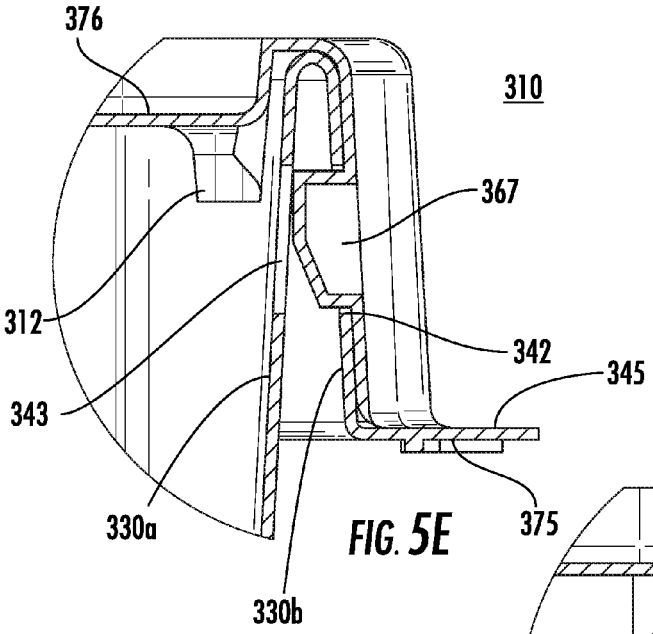
FIGS. 5E-5F illustrate enlarged views of a locking mechanism of the packaging container.
Figure 5F:
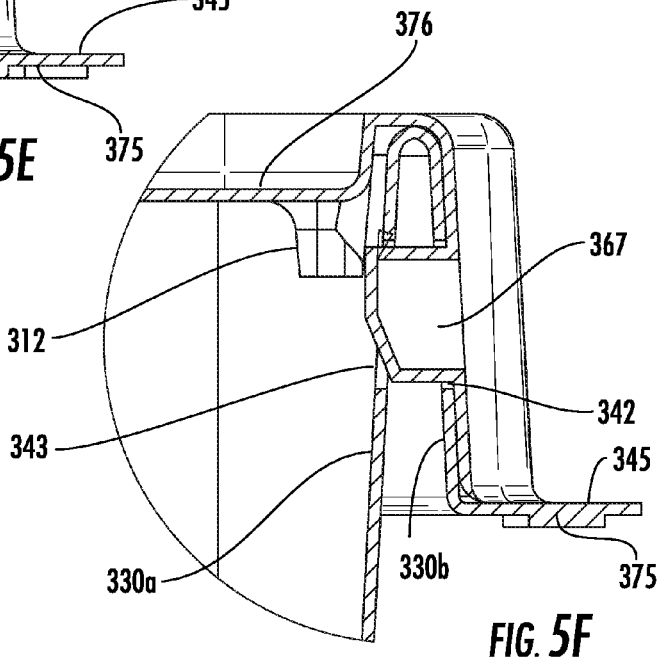

As shown in FIGS. 5C-5F, lockable packaging container 310 may additionally include obstructive members in the form of protuberances 312 extending from the top surface or recessed face 376 adjacent to post 367 of cover section 350. In particular, FIGS. 5C-5D illustrate perspective and side views of locked packaging container 310 according to an embodiment of the invention. FIGS. 5E-5F illustrate enlarged views of a locking mechanism of packaging container 310. As discussed above, laterally extending flange 345 is deformable such that when flange 345 is depressed in a region 375 of outer wall segment 330*b* outer wall segment 330*b* moves inwardly toward inner wall segment 330*a*. However, since recessed face 376 and protuberances 312 extends adjacent to aperture 343 of inner wall segment 330*a*, movement of inner wall segment 330*a* is hindered by protuberances 312. Therefore, post 367 is not released from apertures 342 and 343 and cover section 350 remains secured in a closed position over base section 320. In the embodiment shown in FIG. 5F, post 367 is longer such that movement of inner wall segment 330*a* is further restricted and packaging container 310 is prevented from opening.

Figure 6A:
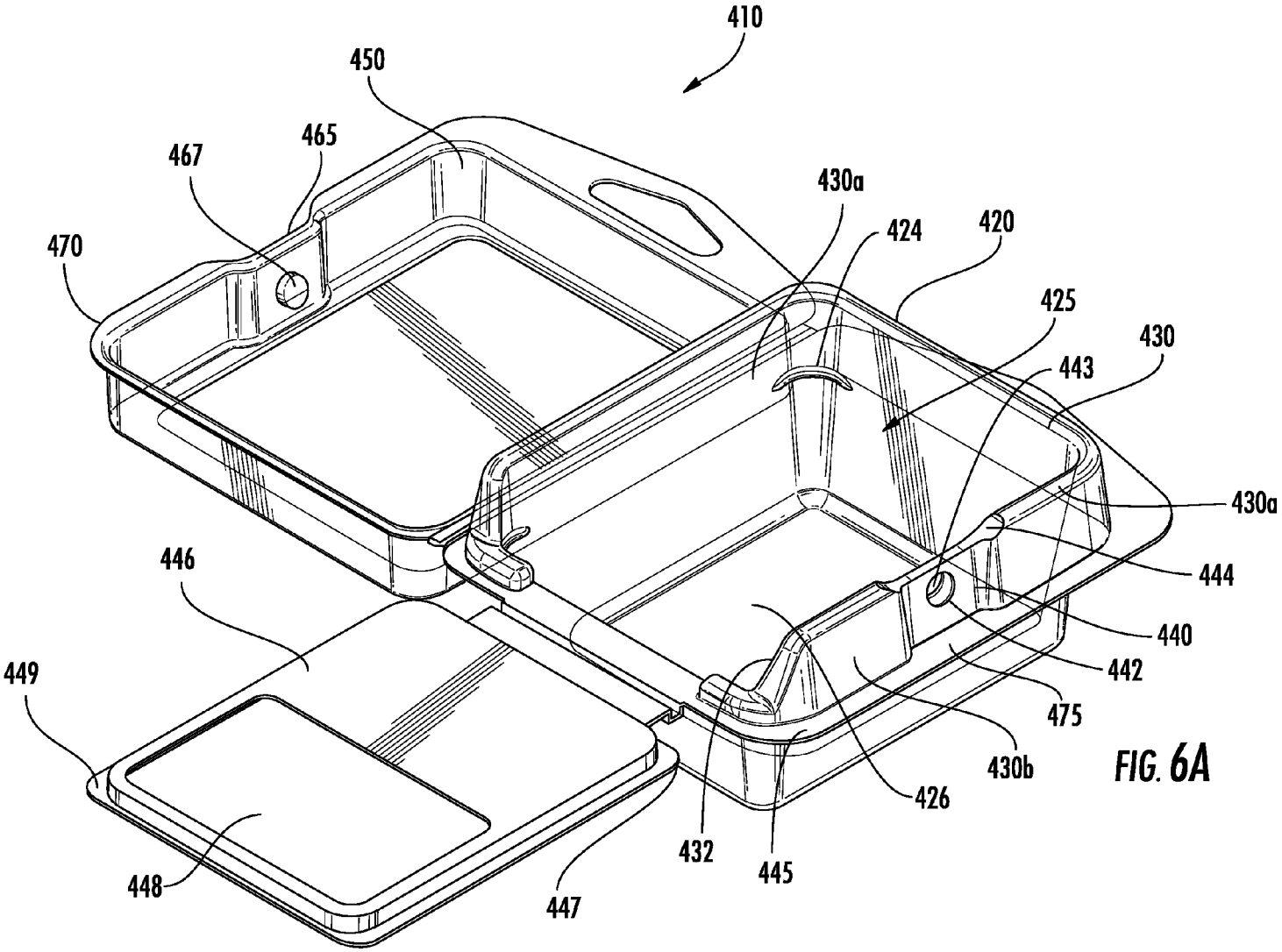
FIGS. 6A-6C illustrate a perspective view of a packaging assembly having a dividing panel in an open state, a perspective view of a packaging assembly having a dividing panel in a partially closed state, and side view of the packaging assembly in a closed state.
Figure 6B:
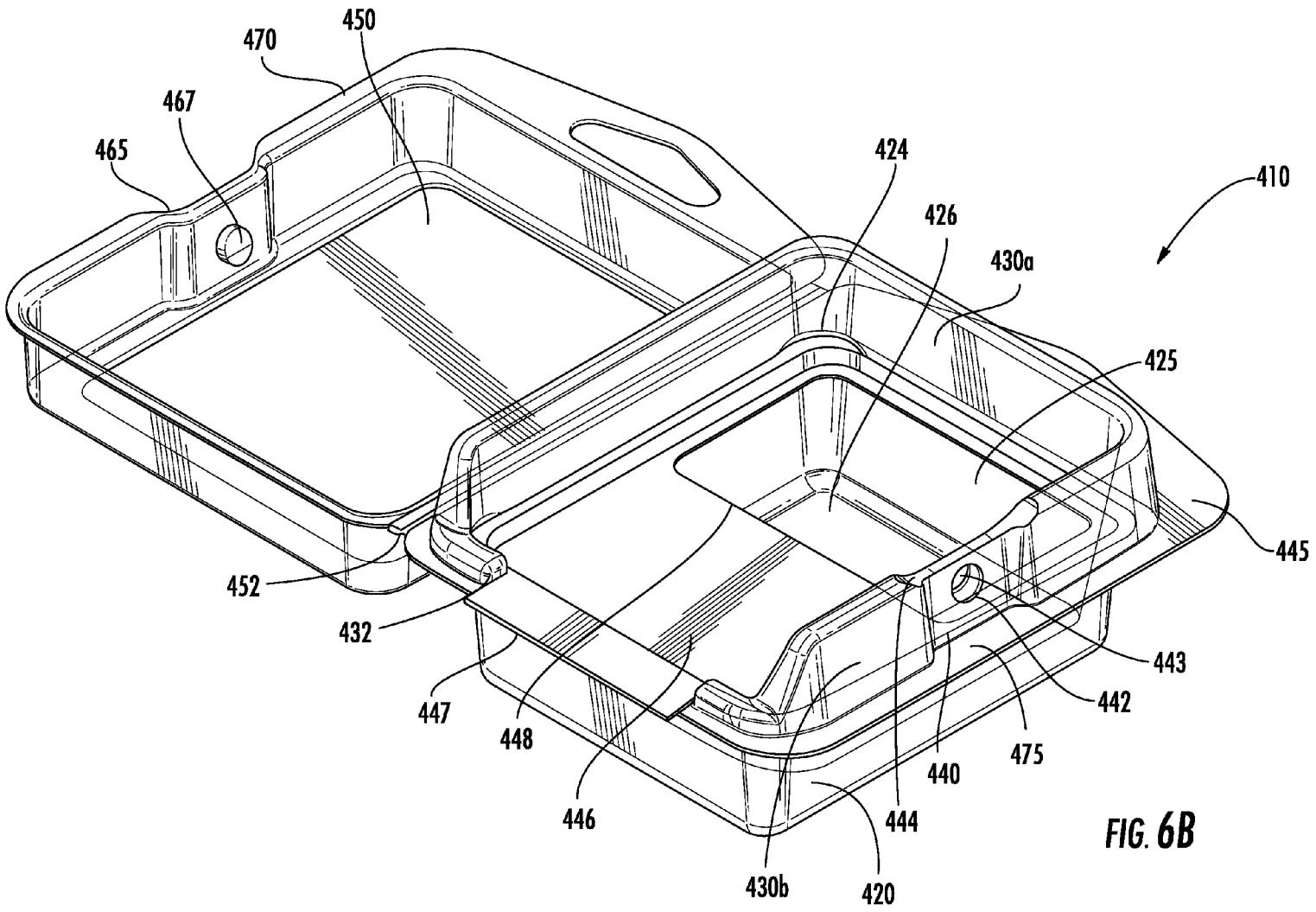
Figure 6C:
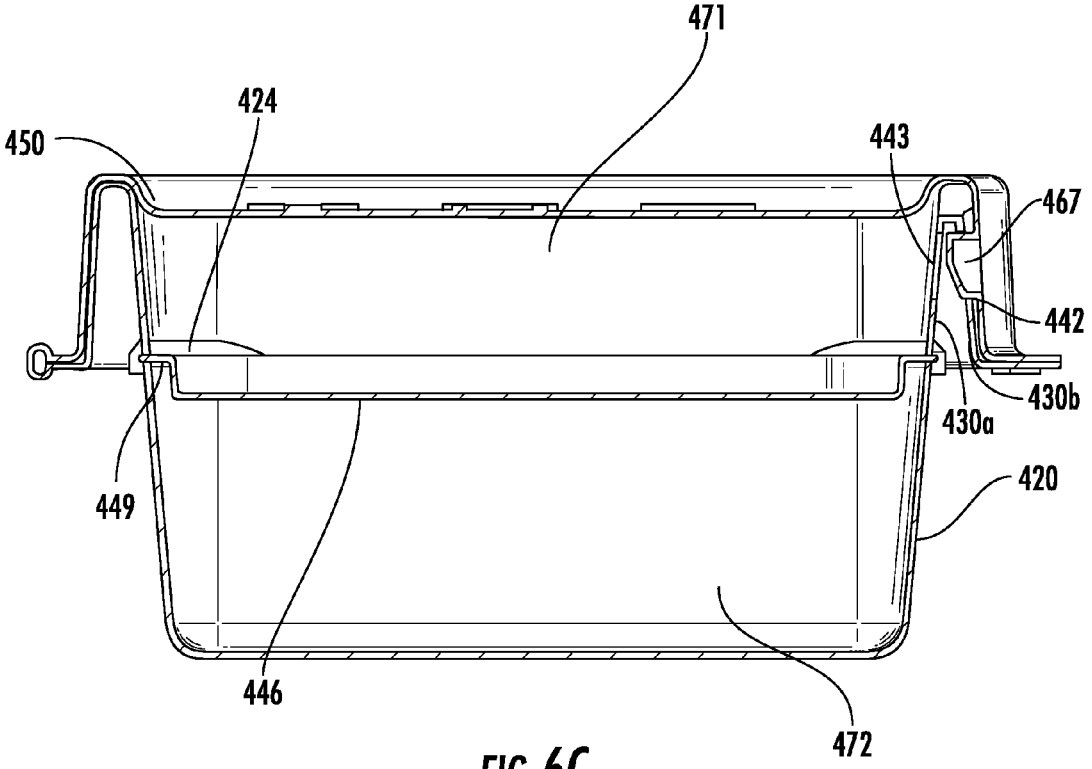

FIGS. 6A-6C illustrate perspective views of an additional embodiment of a packaging container 410 in an open state, a partially closed state, and a closed state. Packaging container 410 includes a base section 420 having a chamber 425 defined by a peripheral wall 430. Peripheral wall 430 forms the perimeter of chamber 425 and is collectively formed by spaced-apart inner wall segment 430*a* and an outer wall segment 430*b* adjoined by a top ledge 430*c*. Peripheral wall 430 extends along three sides of base section 420 and includes an open end 432. Further, chamber 425 includes ridges 424 formed within inner wall segment 430*a* of packaging container 410. A divider plate 446 having a window 448 formed therein is pivotally attached to base section 420 at pivot axis 447. When plate 446 is in an open position, items may be placed in chamber 425. Plate 446 may then be pivoted about pivot axis 447 such that it is parallel to a bottom surface 426 of chamber 425, as shown in FIG. 6B. Alternatively, plate 446 may be closed first allowing items to be placed through window 448 into chamber 425. Plate 446 includes a flange 449 which abuts ridges 424 of chamber 425, thereby holding plate 446 in a position parallel to a bottom surface of chamber 425. Once plate is in a closed position, a cover section 450 may be pivoted over base section 420 at axis 452. As shown in FIG. 6C, plate 446 creates first and second chambers 471 and 472 within packaging container 410. In order to facilitate a secure closure and easy opening of packaging container 410, packaging container 410 includes elements corresponding to those discussed with respect to FIGS. 1A-1F. The closure and release operate in a corresponding manner as previously described.

In particular, in order to facilitate a secure closure of packaging container 410, outer wall segment 430*b* includes at least one depression 440 formed therein. An aperture 442 is formed within depression 440 for engaging an inwardly protruding section formed on a cover section 450. At least one additional aperture 443, which aligns with aperture 442, may also be formed within inner wall segment 430*a*. A scalloped area 444 is also formed therein adjacent to depression 440 formed within outer wall segment 430*b* for facilitating release of cover section 450. Cover section 450 includes at least one inwardly protruding section 465 shaped to correspond with depression 440 formed within outer wall segment 430*b*. In addition, a post 467 projects from inwardly protruding section 465 for engaging corresponding apertures 442 and 443. A peripheral flange 470 extends horizontally from a perimeter of cover section 450 such that, when packaging container 410 is in a closed position, peripheral flange 470 abuts flange 445 of base section 420.

Similar to the embodiment discussed in FIG. 1A, in order to provide a container that is secure when closed, but is also easy to open by a user, packaging container 410 includes features that allows for easy one-hand opening. In particular, laterally extending flange 445 is deformable such that when flange 445 depressed in a region 475 adjacent to depression 440 of outer wall segment 430*b*, outer wall segment 430*b* and inner wall segment 430*a* move inwardly, thereby releasing post 467 from apertures 442 and 443 and opening packaging container 410.

Figure 7A:
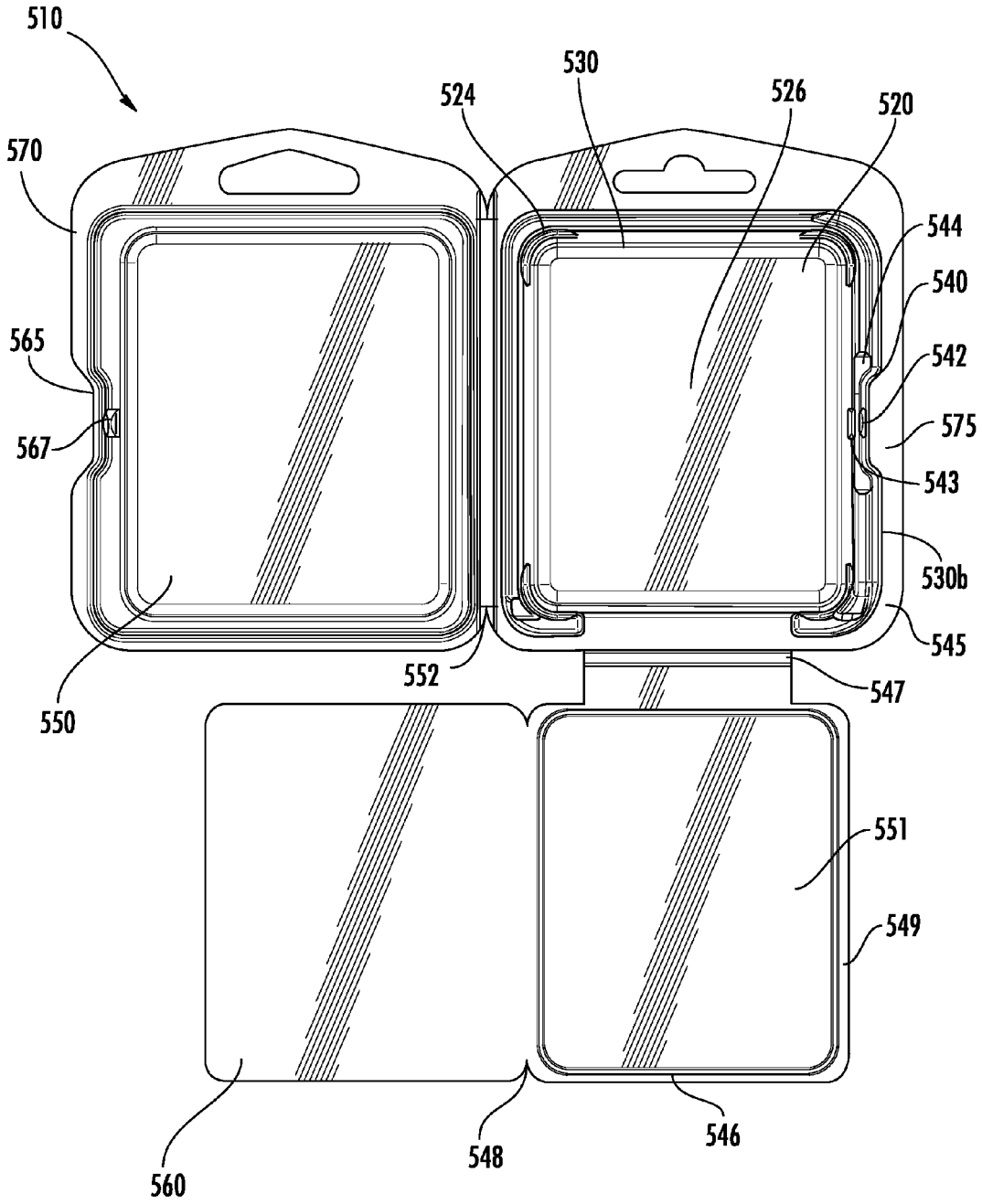
FIGS. 7A-7C illustrate a top open view, a perspective open view, and a closed view of a packaging assembly having multiple chambers.
Figure 7B:
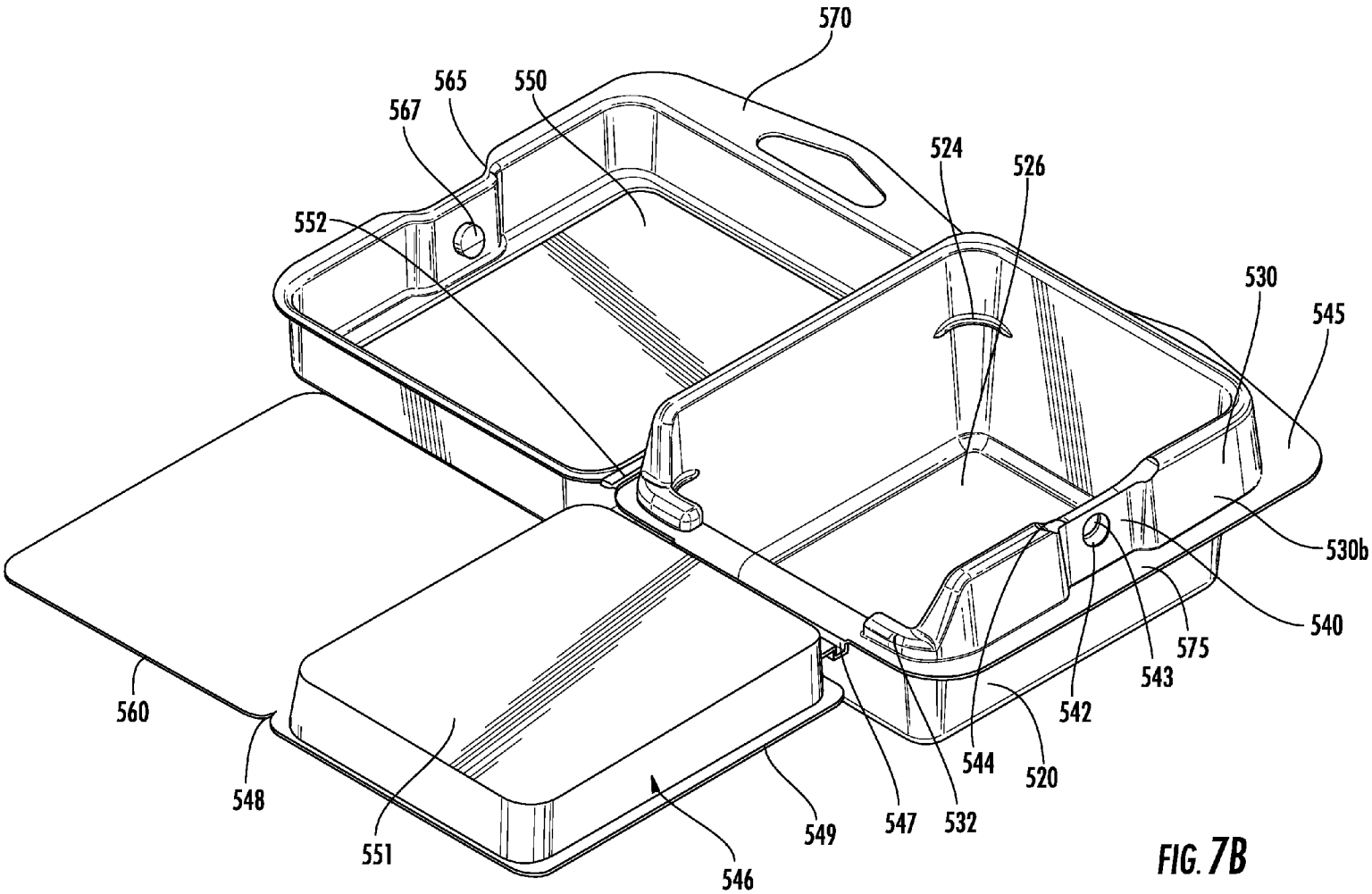
Figure 7C:
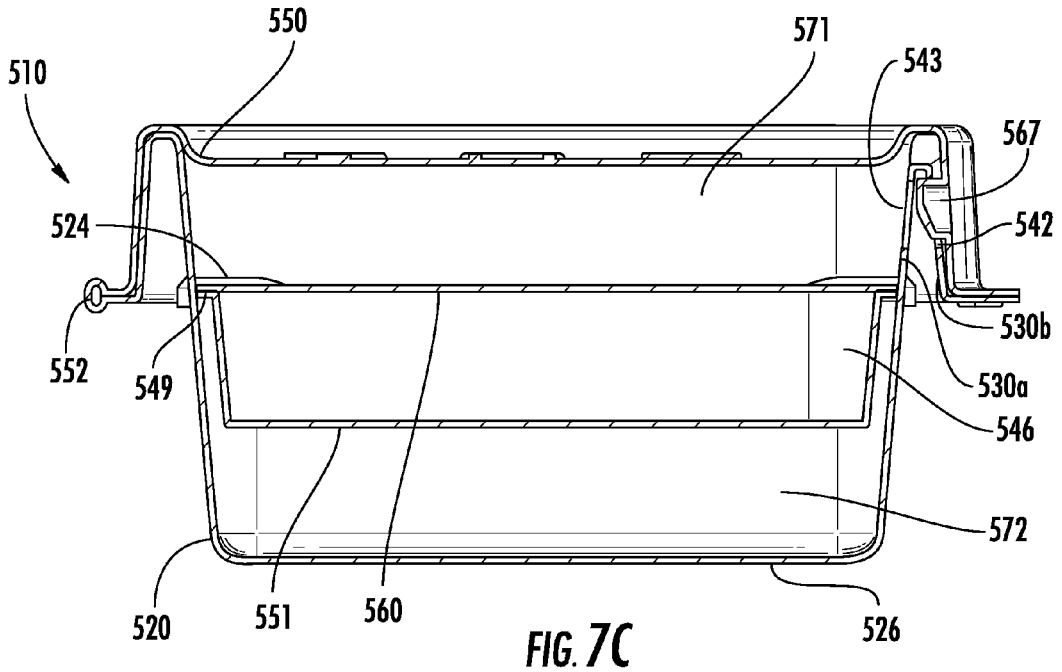

As shown in FIGS. 7A-7C, a packaging container 510 may include multiple chambers. In particular FIGS. 7A-7C illustrate a top open view, a side open view, an end open view and a closed view of a packaging assembly having multiple chambers. Packaging container 510 includes a base section 520 including ridges 524. Peripheral wall 530 extends along three sides of base section 520 and includes an open end 532. A divider chamber 546, having a bottom surface 551 and a cover 560 hinged thereto at axis 548, is pivotally attached to base section 520 at pivot axis 547. Divider chamber 546 includes a flange 549 which abuts ridges 524 of base section 520, thereby holding divider chamber 546 in a position parallel to a bottom surface 526 of base section 520. Once divider chamber 546 is in a closed position, a cover section 550 may be pivoted at axis 552 over base section 520. As shown in FIG. 7C, a first and a second chamber 571 and 572 are created within packaging container 510 above and below divider chamber 546. In order to facilitate a secure closure and easy opening of packaging container 510, packaging container 510 includes elements corresponding to those discussed with respect to FIGS. 1A-1F. The closure and release operate in a corresponding manner as previously described.

In particular, in order to facilitate a secure closure of packaging container 510, outer wall segment 530*b* includes at least one depression 540 formed therein. An aperture 542 is formed within depression 540 for engaging an inwardly protruding section 565 formed on a cover section 550. At least one additional aperture 543, which aligns with aperture 542, may also be formed within inner wall segment 530*a*. A scalloped area 544 is also formed therein adjacent to depression 540 formed within outer wall segment 530*b* for facilitating release of cover section 550. Cover section 550 includes at least one inwardly protruding section 565 shaped to correspond with depression 540 formed within outer wall segment 530*b*. In addition, a post 567 projects from inwardly protruding section 565 for engaging corresponding apertures 542 and 543. A peripheral flange 570 extends horizontally from a perimeter of cover section 550 such that, when packaging container 510 is in a closed position, peripheral flange 570 abuts flange 545 of base section 520.

Similar to the embodiment discussed in FIG. 1A, in order to provide a container that is secure when closed, but is also easy to open by a user, packaging container 510 includes features that allows for easy one-hand opening. In particular, laterally extending flange 545 is deformable such that when flange 545 depressed in a region 575 adjacent to depression 540 of outer wall segment 530*b*, outer wall segment 530*b* and inner wall segment 530*a* move inwardly, thereby releasing post 567 from apertures 542 and 543 and opening packaging container 510.

Figure 8A:
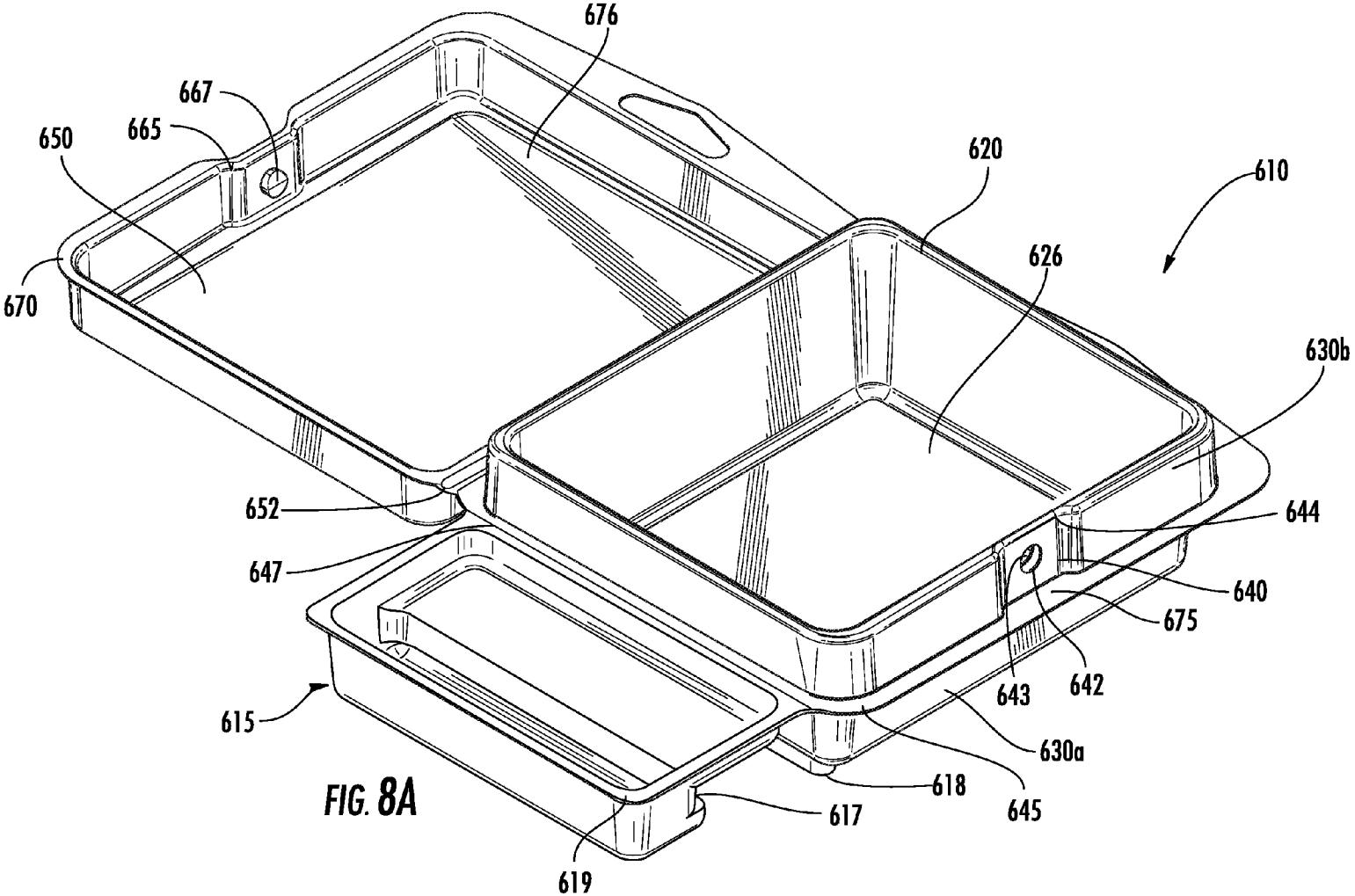
FIGS. 8A-8C illustrate an open perspective view, side view, and side display view of a packaging assembly with a stand.
Figure 8B:
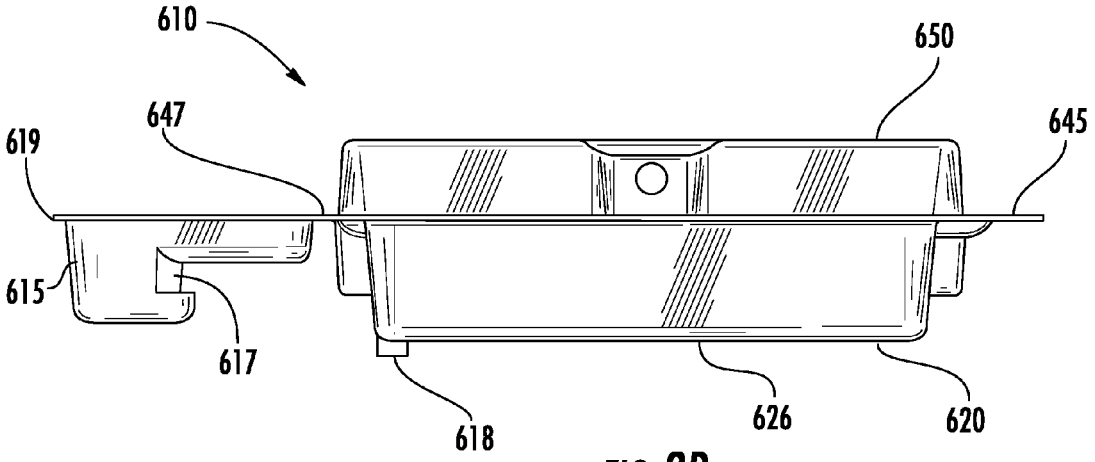
Figure 8C:
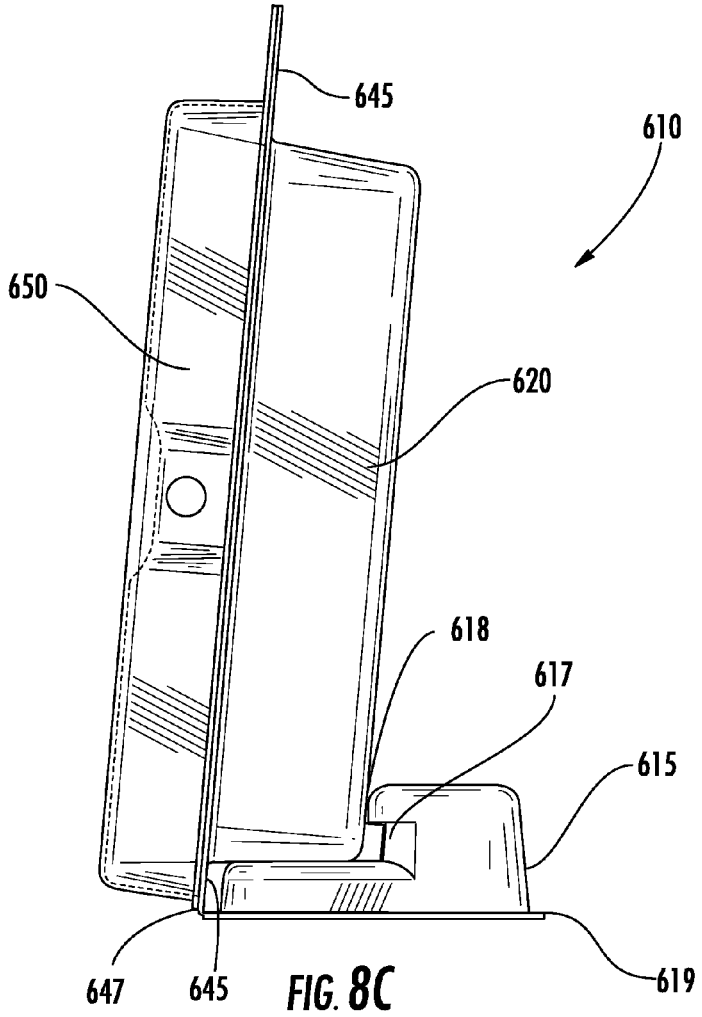

Each of FIGS. 8A-8C illustrates an embodiment of a packaging container 610 having a stand 615 for propping up packaging container 610. In particular, FIGS. 8A-8C illustrate an open perspective view, side view, and side display view of packaging container 610. The elements of packaging container 610 correspond to those described in connection with FIGS. 1A-1G. In particular, packaging container 610 includes base section 620 and cover section 650, which is configured to pivot about hinge 652 between an open state and a closed state. In order to provide a container that is secure when closed, but is also easy to open by a user, packaging container 610 includes features that allows for easy one-hand opening. A laterally extending flange 645 is deformable such that when flange 645 depressed in a region 675 adjacent to a depression 640 of outer wall segment 630*b*, outer wall segment 630*b* and inner wall segment 630*a* (shown in FIG. 8A) move inwardly, thereby releasing post 667 from apertures 642 and 643 and opening packaging container 610. Peripheral flange 670 of cover section 650 includes an inwardly protruding section 665 coupling with depression 640 of base section 620. A scalloped area 644 facilitates the inward movement of outer wall segment 630*b* and inner wall segment 630*a* by ensuring movement is not obstructed by recessed face 676 formed within the top surface.

Packaging container 610 further includes a stand 615 extending from and pivotally coupled to laterally extending flange 645 of base section 620 at hinge 647. Stand 615 includes a C-shaped portion 617 for engaging a notch 618 that extends from a bottom surface 626 of base section 620. When packaging container 610 is in a closed position, stand 615 is rotated about hinge 647 such that notch 618 of packaging container 610 fits within C-shaped portion 617 of stand 615. A flange 619 extends around a perimeter of stand 615, thereby creating a stable base for stand 615. Thus, packaging container 610 is supported in an upright position by stand 615.

Figure 9A:
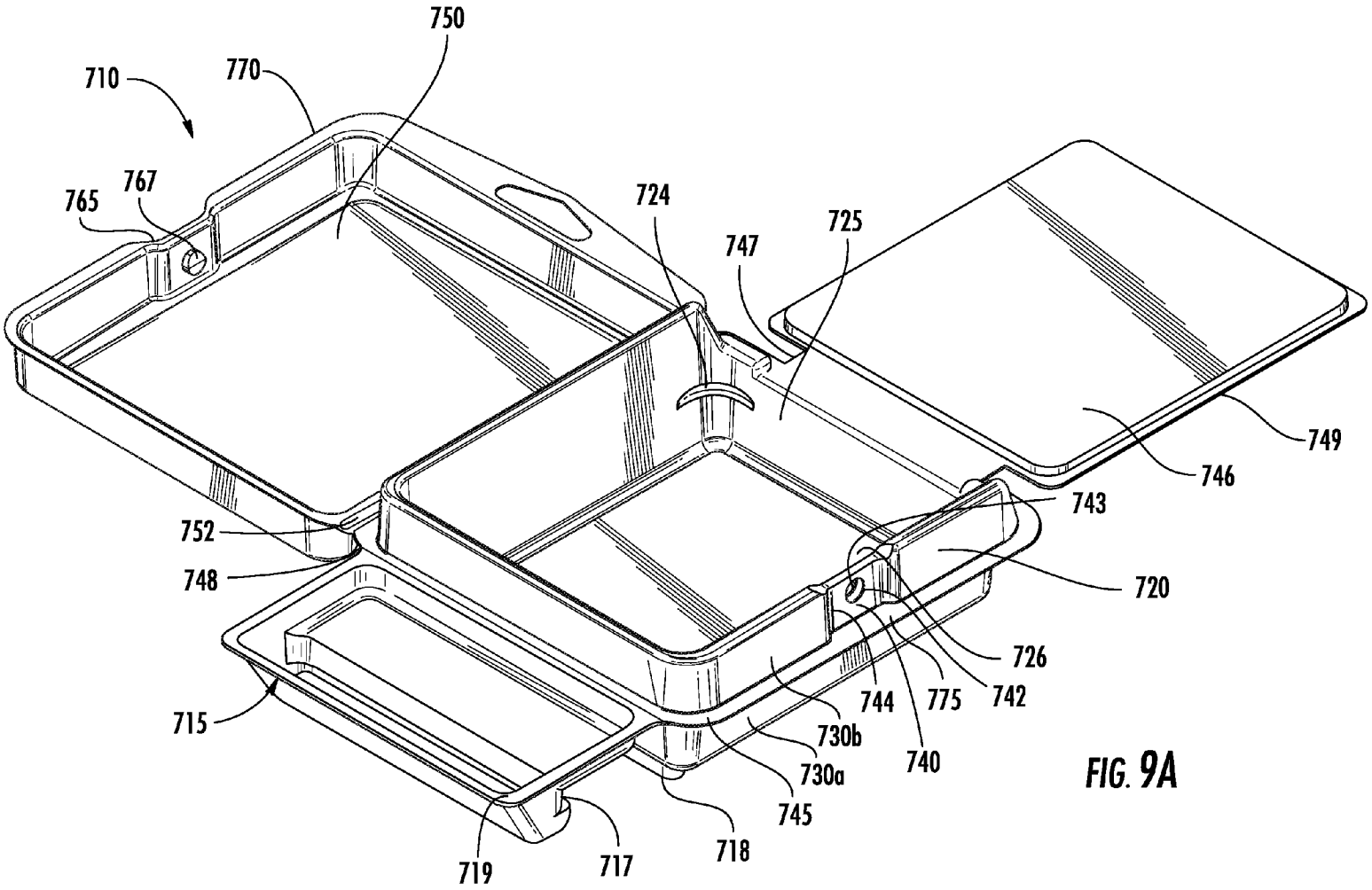
FIGS. 9A-9C illustrate an open perspective view, side open view, and side closed view of a packaging assembly.
Figure 9B:
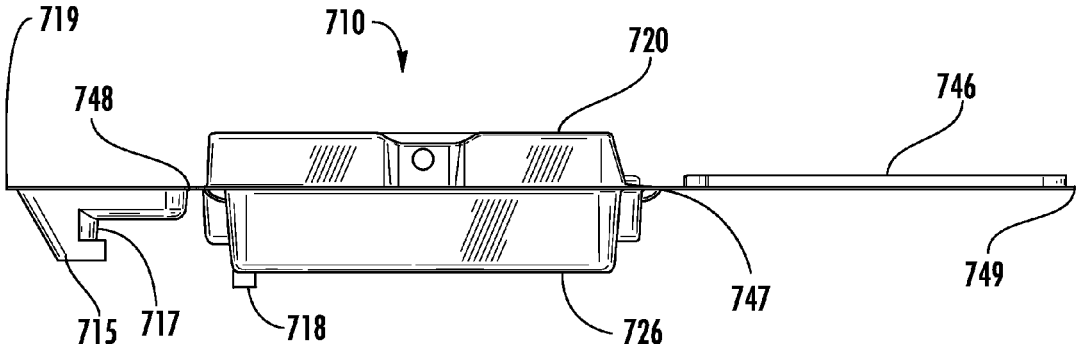
Figure 9C:
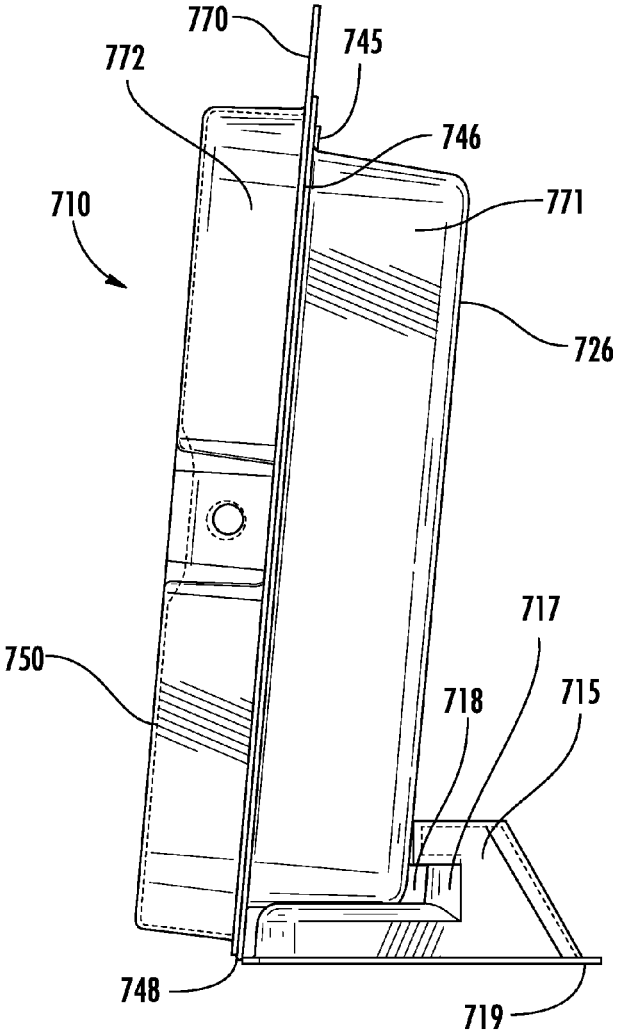

FIGS. 9A-9C illustrate an open perspective view, side open view, and side closed view of packaging assembly 710 having a stand 715. Packaging container 710 includes similar elements to those described in connection with the embodiment shown in FIGS. 6A-6C. In particular, packaging container 710 includes a chamber 725 with ridges 724 formed therein. A divider plate 746 is pivotally attached to base section 720 at pivot axis 747. In some embodiments, divider plate 746 may include a window formed therein. When plate 746 is in an open position, items may be placed in chamber 725. Plate 746 may then be pivoted about pivot axis 747 such that it is parallel to a bottom surface 726 of chamber 725. Alternatively, plate 746 may be closed first allowing items to be placed through a window into chamber 725. Plate 746 includes a flange 749 which abuts ridges 724 of chamber 725, thereby holding plate 746 in a position parallel to a bottom surface of chamber 725. Once plate is in a closed position, a cover section 750 may be pivoted over base section 720 at axis 752. As shown in FIG. 9C, plate 746 creates first and second chambers 771 and 772 within packaging container 710. In order to facilitate a secure closure and easy opening of packaging container 710, packaging container 710 includes elements corresponding to those discussed with respect to FIGS. 1A-1F. The closure and release operate in a corresponding manner as previously described.

In particular, in order to facilitate a secure closure of packaging container 710, outer wall segment 730*b* includes at least one depression 740 formed therein. An aperture 742 is formed within depression 740 for engaging an inwardly protruding section formed on a cover section 750. At least one additional aperture 743, which aligns with aperture 742, may also be formed within inner wall segment 730*a*. A scalloped area 744 is also formed therein adjacent to depression 740 formed within outer wall segment 730*b* for facilitating release of cover section 750. Cover section 750 includes at least one inwardly protruding section 765 shaped to correspond with depression 740 formed within outer wall segment 730*b*. In addition, a post 767 projects from inwardly protruding section 765 for engaging corresponding apertures 742 and 743. A peripheral flange 770 extends horizontally from a perimeter of cover section 750 such that, when packaging container 710 is in a closed position, peripheral flange 770 abuts flange 745 of base section 720.

In order to provide a container that is secure when closed, but is also easy to open by a user, packaging container 710 includes features that allows for easy one-hand opening. In particular, laterally extending flange 745 is deformable such that when flange 745 depressed in a region 775 adjacent to depression 740 of outer wall segment 730*b*, outer wall segment 730*b* and inner wall segment 730*a* move inwardly, thereby releasing post 767 from apertures 742 and 743 and opening packaging container 710.

Further, a stand 715 extends from and is pivotally coupled to laterally extending flange 745 of base section 720 at hinge 748 at an end opposite divider plate 746. Stand 715 includes a C-shaped portion 717 for engaging a notch 718 that extends from a bottom surface 726 of base section 720. As noted above, when plate 746 is in an open position, items may be placed in chamber 725. Plate 746 may then be pivoted about pivot axis 747 such that it is parallel to a bottom surface of chamber 725. Plate 746 includes a flange 749 which abuts ridges 724 of chamber 725, thereby holding plate 746 in a position parallel to a bottom surface of chamber 725. Once plate is in a closed position, a cover section 750 may be pivoted over base section 720, securing packaging container 710 in a closed position. Stand 715 may then be rotated about hinge 748 such that notch 718 of packaging container 710 fits within C-shaped portion 717 of stand 715. A flange 719 extends around a perimeter of stand 615, thereby creating a stable base for stand 715. Thus, packaging container 710 is securely supported in an upright position by stand 715 as shown in FIG. 9C.

Figure 10A:
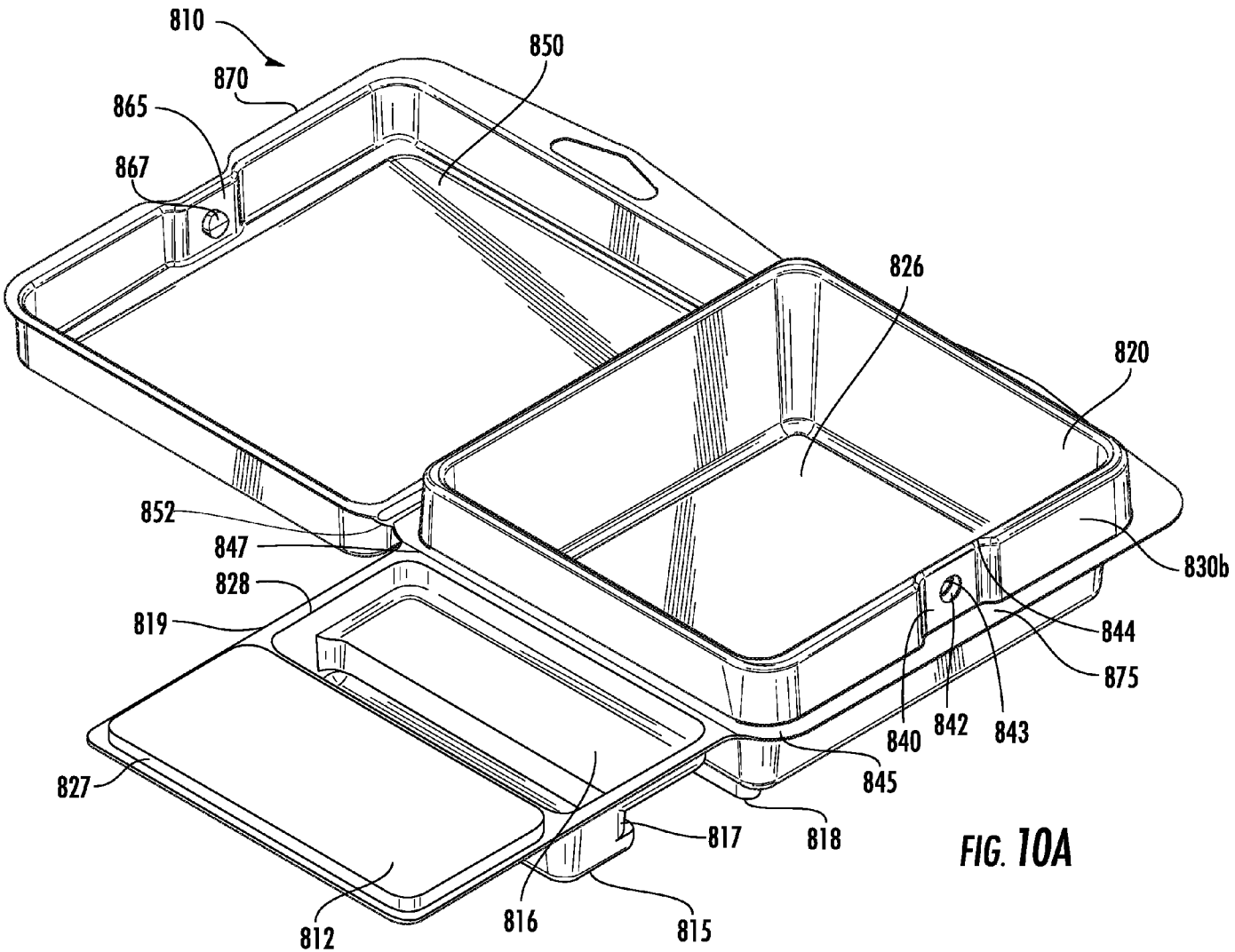
FIGS. 10A-10C illustrate an open perspective view, side open view, and side display view of a packaging assembly with compartment and a stand.
Figure 10B:
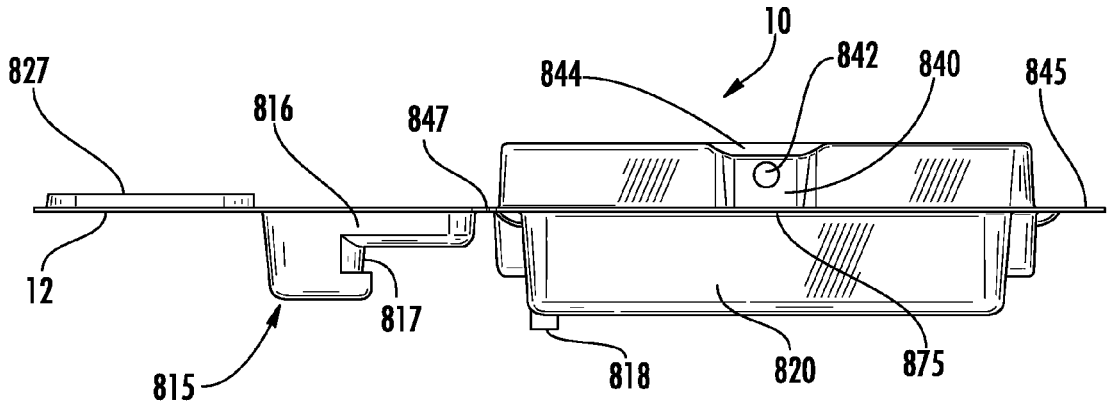
Figure 10C:
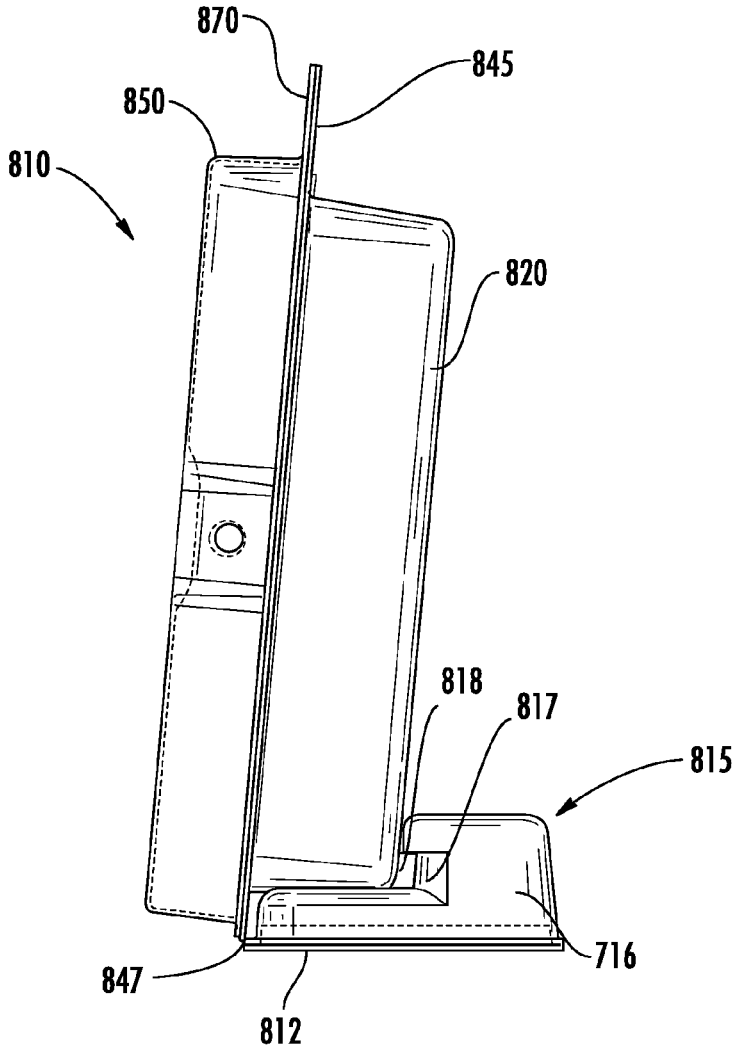

FIGS. 10A-10C illustrate an open perspective view, side open view, and side display view of an additional embodiment of packaging container 810, including a stand 815 having a chamber 816 formed therein. The elements of packaging container 810 correspond to those described in connection with FIGS. 1A-1G. In particular, packaging container 810 includes base section 820 and cover section 850, which is configured to pivot about hinge 852 between an open state and a closed state. In order to provide a container that is secure when closed, but is also easy to open by a user, packaging container 810 includes features that allows for easy one-hand opening. A laterally extending flange 845 is deformable such that when flange 845 depressed in a region 875 adjacent to a depression 840 of outer wall segment 830*b*, outer wall segment 830*b* and inner wall segment 830*a* move inwardly, thereby releasing post 867 from apertures 842 and 843 and opening packaging container 810. Peripheral flange 870 of cover section 850 includes an inwardly protruding section 865 coupling with depression 840 of base section 820. A scalloped area 844 facilitates the inward movement of outer wall segment 830*b* and inner wall segment 830*a* by ensuring movement is not obstructed by recessed face 876.

Packaging container 810 further includes a stand 815 extending from and pivotally coupled to laterally extending flange 845 of base section 820 at hinge 847. Stand 815 includes a C-shaped portion 817 for engaging a notch 818 that extends from a bottom surface 826 of base section 820. Further, stand 815 includes a hollow interior portion forming a chamber 816 covered by a lid 812 pivotally coupled thereto. Lid 812 includes a depressed face portion 827 for mating with a perimeter 828 of chamber 816 to provide a secure closure of chamber 816. When packaging container 810 and chamber 815 are in closed positions, stand 815 is rotated about hinge 847 such that notch 818 of packaging container 810 fits within C-shaped portion 817 of stand 815. A flange 819 extends around a perimeter of chamber 815 and lid 812, thereby creating a stable base for stand 815. Thus, packaging container 810 is supported in an upright position by stand 815 that further includes chamber 816 for storing additional items.

Hereinafter, a process of manufacturing the packaging container according to an embodiment of the present invention is described. The process will be described with specific reference to the embodiment of FIGS. 1A-1G. However, it to be understood that the process applies to all of the embodiment disclosed herein. Packaging container 10 may be formed completely or partially of a transparent material to allow a user to see the interior of the packaging container. In particular, packaging container 10 is manufactured using a thermoforming process. In order to produce a projection, such as post 67, or other shaped projection in a vertical or nearly vertical sidewall of a thermoformed package, retractable tooling features are incorporated into a tool, which forms the package. These features can be of a variety of shapes and sizes.

Packaging container 10 is formed from a preheated sheet of thermoplastic material that is drawn into, or over a mold to create the desired shape of the end product. After the material has reached a stable set point, where upon it is rigid enough to be removed from the mold without losing the shape of the mold upon which it was formed, the sheet is withdrawn in the opposite direction from which it entered the mold. Typically the sheet enters the mold and is removed from the mold in a vertical fashion. Posts 67 are formed utilizing retractable features, such as a round post, or pin. When the heated plastic sheet is drawn into the mold the post is in an extended position. The plastic forms around the post, adopting its shape. The post is then retracted until the face of the post is flush with the sidewall of the mold. Thus, the post is out of the way such that the plastic product can be removed from the mold. Mechanical linkages and drive mechanisms may be used. Alternately, magnetics, pneumatic cylinders or the like may be employed. The timing of the projection of the feature outbound from the sidewall of the mold may be fine-tuned by being in the fully extended position prior to the heated material entering the mold and being activated just after the material has entered the mold, but prior to the material cooling beyond the point where it will be able to form around the feature.

Apertures 42 and 43 are formed within outer wall segment 30*b* and inner wall segment 30*a* of wall 30, which are vertical or nearly vertical surfaces. A punch and die mechanism is utilized to form apertures 42 and 43. The punch and die may mimic the profile of the formed post 67, but with a slightly larger profile to allow for clearance and ease of insertion of the formed posts 67 within apertures 43 and 43. Alternatively, the cutout may take a shape that is different from the formed projection. For example, the formed projection could be a simple post, but the cutout could be oval in shape. The function of projections or posts 67 and cutouts or apertures 42, 43 is to prevent the vertical opening of cover section 50 of packaging container 10. Similarly, apertures 42, 43 may be round and projections may be star, octagonal, or the like, in shape. Apertures 42 and 43 are formed after the forming of packaging container 10. Thus, the plastic has formed into the mold, the plastic has been demolded and then the apertures are cutout. In high volume production the cutting of the hole feature occurs at a station between a forming station and a die cutting station. It is in the die cutting station that the planer surfaces of the plastic container are trimmed from the surrounding web of material so that the container can be removed from a leftover perimeter sheet.

Apertures 42 and 43 may also be formed following a die cutting step, i.e. after the formed and die cut plastic part has been removed from the surrounding left over plastic sheet. Thus, the last step in the process is to place the formed and die cut package into a mechanical device, which then punches out the holes. The holes may be formed by a manually actuated device punching one hole at a time or by a fully automated system punching all the holes in a package at once, with automated load and unload of the package into the punching mechanism. The holes may also be cut in the same station as where the planer die cut of the perimeter plastic occurs.

In use, an item or items is placed in chamber 25 of base section 20. Cover section 50 is then rotated to cover base section 20. At this time, post 67 and inwardly protruding section 65 engages depression 40 and corresponding aperture 42. In particular, post 67 of cover section 50 penetrates aperture 42 of base section 20, thereby securing cover section 50 to base section 20. Post 67 includes an angled edge 67*a* and a top edge 67*b*. Post 67 penetrates corresponding aperture 42 to prevent base section 50 from being pivoted open. Aperture 43 is provided in inner wall segment 30*a* such that post 67 may penetrate aperture 43 if first lateral wall 55 is pushed inwardly. Thus, inward deflection of lateral wall 55 will not cause post 67 to become disengaged from apertures 42. In order to open packaging container 10, outer wall segment 30*b* must be deflected such that post 67 disengages from corresponding aperture 42. In particular, applying downward pressure to deformable flange 45 in an area adjacent to depression 40 causes such deflection of outer wall segment 30*b* such that post 67 disengages from corresponding aperture 42 and container 10 is opened.

In general, the posts and apertures engage to form a locking feature that uses the shear strength of a post engaged against the wall of material through which the aperture is formed. The force required to separate the posts from the apertures is a function of the shear strength of the formed post, and or the tear strength of the punched hole, rather than the function of friction.

The downward force of closing cover section 50 over base section 20 drives post 67 having beveled or angled edge 67*a* down across the outer wall segment 30*b* descending the wall of the package until the post "snaps" into the hole. Since the posts and apertures are formed on vertical walls at 90 degrees, no additional material is required to form a secure closure of packaging container 10.

Although the present invention has been described with reference to the embodiments and the accompanying drawings, it is not limited to the embodiments and the drawings. It should be understood that various modifications and changes can be made by those skilled in the art without departing from the spirit and scope of the present invention defined by the accompanying claims.

I claim:

1. A packaging container having a secure closure comprising:

a base section having a bottom surface and spaced apart inner and outer wall segments, said outer wall segment having a deformable flange extending laterally therefrom;

a cover section having a top surface and a side wall portion, said cover section adapted to cover said base section when in a closed state; and a closure mechanism including at least one first aperture formed within said inner wall segment of the base section and at least one second aperture formed within the outer wall segment of the base section aligned with said at least one first aperture, at least one projection extending inward from the side wall portion of the cover section for engaging the at least one first aperture and being adapted to engage the at least one second aperture of the base section, said closure mechanism retaining the cover section over the base section and securing the packaging container in a closed position; and an obstructive member formed within the cover section extending towards the at least one first aperture formed within said inner wall segment of the base section when the packaging container is in a closed position such that movement of the inner wall segment is hindered by the obstructive member when the deformable flange is depressed, preventing the projection from being released from the at least one first aperture and the at least one second aperture.

2. The packaging container of claim 1, wherein the obstructive member is a recessed face formed within the top surface of the cover section.

3. The packaging container of claim 2 further comprising at least one protuberance extending from the recessed face adjacent to the at least one projection of cover section for further hindering movement of the inner wall segment.

4. The packaging container of claim 1 further comprising at least one depression formed within the outer wall segment wherein said at least one aperture is formed within the at least one depression.

5. The packaging container of claim 4 further comprising at least one inwardly protruding section formed in the side wall portion of the cover section shaped to correspond with said at least one depression formed within the outer wall segment of the base section, wherein said at least one projection in formed within the at least one inwardly protruding section.

6. The packaging container of claim 5 further comprising a peripheral flange extending laterally from the side wall portion of the cover section, said peripheral flange adapted to contact said laterally extending flange of said base section when the packaging container is in a closed position.

7. The packaging container of claim 1 wherein the at least one projection formed in the base section is a post having an angled edge.

8. The packaging container of claim 1 further including a stand pivotally connected to the base section, said stand providing support for propping up the packaging container.

9. The packaging container of claim 1 wherein the base section includes a plurality of wells formed in a bottom surface thereof.

10. The packaging container of claim 9 further comprising a plate pivotally attached to said base section, said plate including a plurality of holes formed therein for aligning with the plurality of wells formed in the bottom surface, said plate adapted to secure items positioned in the wells.

11. The packaging container of claim 2 wherein the recessed face formed in the top surface of the cover section forms a receiving area for retaining a bottom wall of the base section of a second packaging container, thereby allowing the packaging containers to be stacked.

12. A closure mechanism for a packaging container having a base section with a bottom surface and spaced apart inner and outer wall segments, said outer wall segment having a deformable flange extending laterally therefrom; a cover section having a top surface, a side wall portion, and an obstructive member formed therein, said cover section adapted to cover said base section when in a closed state, said closure mechanism including:

at least one first aperture formed within said inner wall segment of the base section and at least one second aperture formed within the outer wall segment of the base section aligned with said at least one first aperture, at least one projection extending inwardly from the side wall portion of the cover section for engaging the at least one first aperture and being adapted to engage the at least one second aperture of the base section, said closure mechanism retaining the cover section over the base section and securing the packaging container in a closed position such that movement of the inner wall segment is hindered by the obstructive member when the deformable flange is depressed, preventing the projection from being released from the at least one first aperture and the at least one second aperture.

13. The closure mechanism of claim 12 wherein the obstructive member is a recessed face formed within the top surface of the cover section.

14. The closure mechanism of claim 13, further comprising at least one protuberance extending from the recessed face adjacent to the at least one projection of cover section for further hindering movement of the inner wall segment.

* * * * *